United States Patent [19]

Yagasaki et al.

[11] Patent Number: 4,656,338

[45] Date of Patent: Apr. 7, 1987

[54] RECORDING APPARATUS

[75] Inventors: Toshiaki Yagasaki, Hino; Kouki Kuroda, Tokyo; Tsuneki Inuzuka, Machida, all of Japan

[73] Assignee: Canon Kabushiki Kaisha, Tokyo, Japan

[21] Appl. No.: 524,397

[22] Filed: Aug. 18, 1983

[30] Foreign Application Priority Data

| | | | |
|---|---|---|---|
| Aug. 23, 1982 | [JP] | Japan | 57-145830 |
| Jan. 28, 1983 | [JP] | Japan | 58-13551 |
| Jan. 28, 1983 | [JP] | Japan | 58-13552 |

[51] Int. Cl.[4] ..... H05B 1/02

[52] U.S. Cl. ..... 219/497; 219/492; 219/216; 323/235

[58] Field of Search ..... 219/216, 492, 493, 497, 219/507; 236/46 R; 323/235, 236, 319

[56] References Cited

U.S. PATENT DOCUMENTS

| | | | |
|---|---|---|---|
| 3,548,155 | 12/1970 | Rabindran | 219/497 |
| 4,006,985 | 2/1977 | Hutner | 219/216 |
| 4,314,143 | 2/1982 | Bilstad et al. | 219/497 |
| 4,404,462 | 9/1983 | Murray | 219/497 |
| 4,467,183 | 8/1984 | Ishima | 219/492 |

*Primary Examiner*—M. H. Paschall

*Attorney, Agent, or Firm*—Fitzpatrick, Cella, Harper & Scinto

[57] ABSTRACT

A recording apparatus in which a control unit utilizes a copy counter for plural purposes. The control unit also achieves other features such as securer jam detection, a constant operation regardless of the frequency of commercial power supply, securer timing and temperature control with limited number of sensors.

17 Claims, 59 Drawing Figures

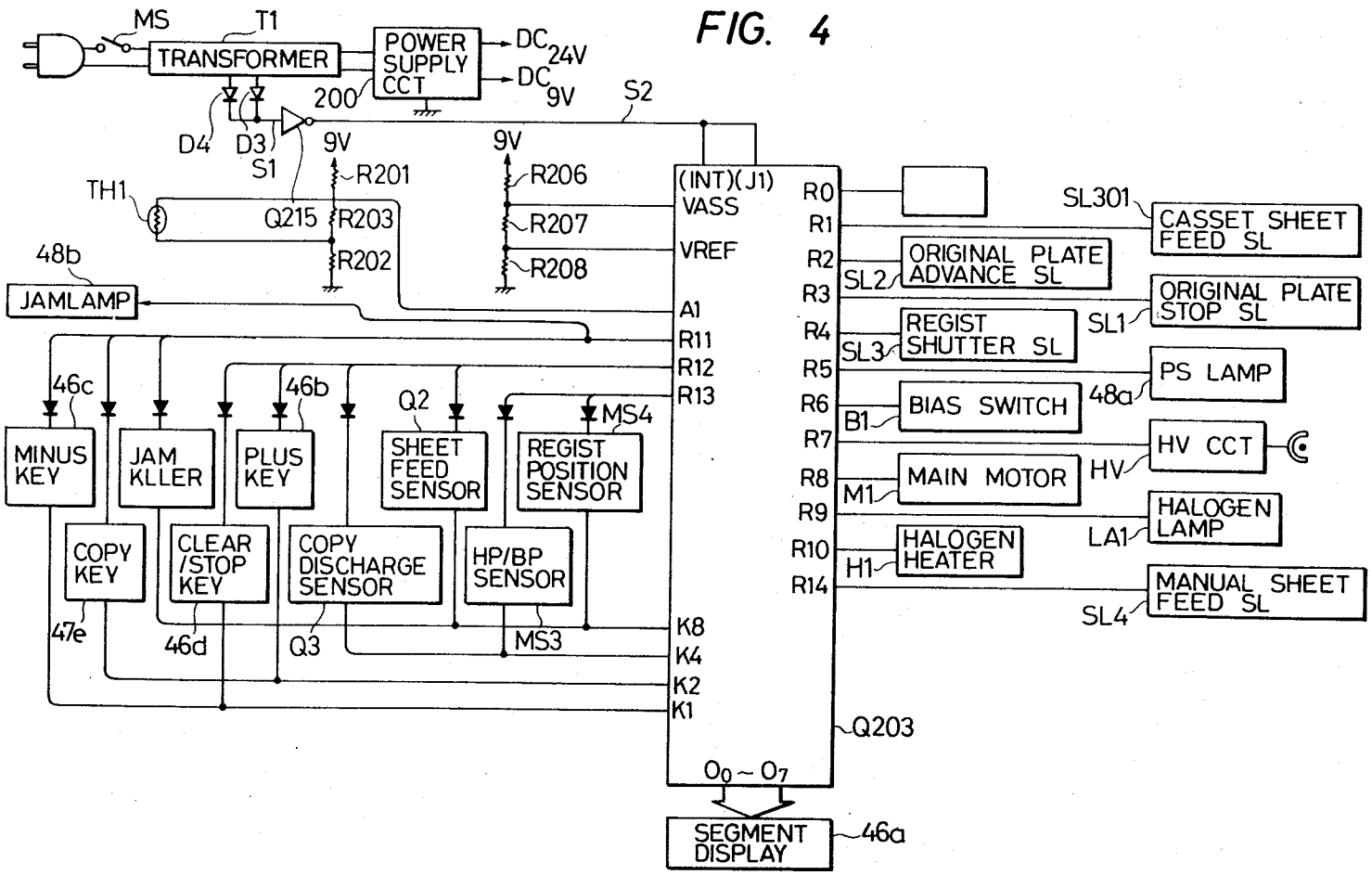
FIG. 4
CASSET SHEET FEED SL
ORIGINAL PLATE STOP SL
PS LAMP
HV CCT
HALOGEN LAMP
MANUAL SHEET FEED SL
SL301
SL1
48a
HV
LA1
SL4
ORIGINAL PLATE ADVANCE SL
REGIST SHUTTER SL
BIAS SWITCH
MAIN MOTOR
HALOGEN HEATER
SL2
SL3
B1
M1
H1
Q203
46a
R0
R1
R2
R3
R4
R5
R6
R7
R8
R9
R10
R14
(INT)(J1)
VASS
VREF
A1
R11
R12
R13
K8
K4
K2
K1
O0 ~ O7
SEGMENT DISPLAY
S2
MS4
REGIST POSITION SENSOR
HP/BP SENSOR
MS3
R206
R207
R208
9V
DC24V
DC9V
POWER SUPPLY CCT
200
Q2
SHEET FEED SENSOR
COPY DISCHARGE SENSOR
Q3
R201
R203
R202
Q215
S1
D3
D4
T1
TRANSFORMER
MS
46b
PLUS KEY
CLEAR /STOP KEY
46d
JAM KLLER
COPY KEY
47e
46c
MINUS KEY
TH1
48b
JAMLAMP FIG. 6(a)
FIG. 6(b)
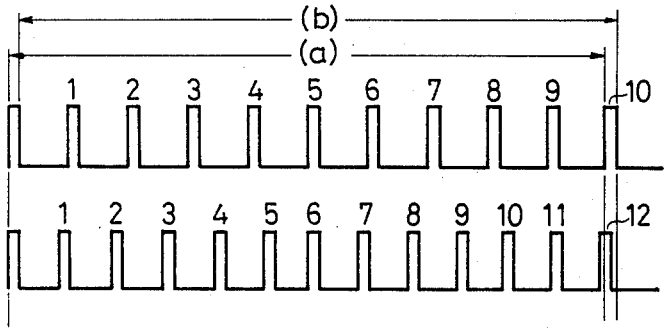
FIG. 7(a)
FIG. 7(b)
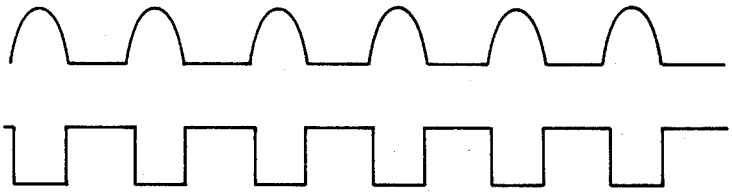

| | R11 | R12 | R13 |
|---|---|---|---|
| K1 | MINUS(-) KEY 46c | CLEAR/STOP KEY 46d | |
| K2 | COPY KEY 47e | PLUS(+) KEY 46b | |
| K4 | | COPY DISCHARGE SENSOR Q3 | HP/BP SENSOR MS3 |
| K8 | JAM KILLER | SHEET FEED SENSOR Q2 | REGIST POSITION SENSOR MS4 |
| A1 | TEMPERATURE CONTROL ELEMENT ANALOG INPUT | | |

FIG. 10

| | |
|---|---|
| R0 | UNUSED |
| R1 | CASSETTE SHEET FEED SOLENOID (SL301) |
| R2 | ORIGINAL PLATE ADVANCE SOLENOID (SL2) |
| R3 | ORIGINAL PLATE STOP SOLENOID (SL1) |
| R4 | RESIST SHUTTER SOLENOID (SL3) |
| R5 | PS LAMP 48a |
| R6 | BIAS SWITCH CCT |
| R7 | HV CCT HV |
| R8 | MAIN MOTOR M1 |
| R9 | HALOGEN LAMP LA1 |
| R10 | HALOGEN HEATER H1 |
| R14 | MANUAL SHEET FEED SOLENOID (SL4) |
| $O_0$ ~$O_7$ | SEGMENT DISPLAY 46a $O_0$ $O_7$/$O_5$/$O_6$/$O_1$ /$O_4$/ /$O_2$ $O_3$ |
| R11 | JAM INDICATE LAMP 48b |

FIG. 12(a)

| RESISTANCE (KΩ) OF THERMISTER TH1 | VALUE OF A/D |
|---|---|
| 0.0 | 00 |
| 0.1 | 00 |
| 0.2 | 02 |
| 0.3 | 05 |
| 0.4 | 09 |
| 0.5 | 0C |
| 0.6 | 0F |
| 0.7 | 12 |
| 0.8 | 15 |
| 0.9 | 18 |
| 1.0 | 1B |
| 1.1 | 1E |
| 1.2 | 20 |
| 1.3 | 23 |
| 1.4 | 26 |
| 1.5 | 28 |
| 1.6 | 2B |
| 1.7 | 2D |
| 1.8 | 2F |
| 1.9 | 32 |
| 2.0 | 34 |
| 2.1 | 36 |
| 2.2 | 38 |
| 2.3 | 3A |
| 2.4 | 3C |
| 2.5 | 3E |
| 2.6 | 40 |
| 2.7 | 42 |
| 2.8 | 44 |
| 2.9 | 46 |
| 3.0 | 48 |
| 3.1 | 4A |
| 3.2 | 4B |
| 3.3 | 4D |
| 3.4 | 4E |
| 3.5 | 50 |
| 3.6 | 52 |
| 3.7 | 54 |
| 3.8 | 55 |
| 3.9 | 57 |
| 4.0 | 58 |

FIG. 12(b)

| RESISTANCE (KΩ) OF THERMISTER TH1 | VALUE OF A/D |
|---|---|
| 4.1 | 5A |
| 4.2 | 5B |
| 4.3 | 5D |
| 4.4 | 5E |
| 4.5 | 5F |
| 4.6 | 61 |
| 4.7 | 62 |
| 4.8 | 63 |
| 4.9 | 65 |
| 5.0 | 66 |
| 5.1 | 67 |
| 5.2 | 68 |
| 5.3 | 69 |
| 5.4 | 6B |
| 5.5 | 6C |
| 5.6 | 6D |
| 5.7 | 6E |
| 5.8 | 6F |
| 5.9 | 70 |
| 6.0 | 71 |
| 6.1 | 72 |
| 6.2 | 73 |
| 6.3 | 74 |
| 6.4 | 75 |
| 6.5 | 76 |
| 6.6 | 77 |
| 6.7 | 78 |
| 6.8 | 79 |
| 6.9 | 7A |
| 7.0 | 7B |
| 7.1 | 7C |
| 7.2 | 7D |
| 7.3 | 7E |
| 7.4 | 7F |
| 7.5 | 80 |
| 7.6 | 80 |
| 7.7 | 81 |
| 7.8 | 82 |
| 7.9 | 83 |
| 8.0 | 84 |

FIG. 12(c)

| RESISTANCE (KΩ) OF THERMISTER TH1 | VALUE OF A/D |
|---|---|
| 8.1 | 84 |
| 8.2 | 85 |
| 8.3 | 86 |
| 8.4 | 87 |
| 8.5 | 87 |
| 8.6 | 88 |
| 8.7 | 89 |
| 8.8 | 8A |
| 8.9 | 8A |
| 9.0 | 8B |
| 9.1 | 8C |
| 9.2 | 8C |
| 9.3 | 8D |
| 9.4 | 8E |
| 9.5 | 8E |
| 9.6 | 8F |
| 9.7 | 90 |
| 9.8 | 90 |
| 9.9 | 91 |
| 10.0 | 92 |
| 10.1 | 92 |
| 10.2 | 93 |
| 10.3 | 93 |
| 10.4 | 94 |
| 10.5 | 95 |
| ⋮ | ⋮ |
| 100.0 | E9 |
| 200.0 | F1 |
| 300.0 | F4 |
| 400.0 | F5 |
| 500.0 | F6 |
| 600.0 | F7 |
| 700.0 | F7 |
| 800.0 | F8 |

FIG. 13(a)

| TEMP. (°C) | RESISTANCE (KΩ) |
|---|---|
| 0 | 804.8 |
| 5 | 617.5 |
| 10 | 478.2 |
| 15 | 372.6 |
| 20 | 292.8 |
| 25 | 231.4 |
| 30 | 184.0 |
| 35 | 147.1 |
| 40 | 118.5 |
| 45 | 95.86 |
| 50 | 78.06 |
| 55 | 63.86 |
| 60 | 52.56 |
| 65 | 43.45 |
| 70 | 36.12 |
| 75 | 30.16 |
| 80 | 25.31 |
| 85 | 21.32 |
| 90 | 18.04 |
| 95 | 15.32 |
| 100 | 13.06 |
| 105 | 11.16 |

FIG. 13(b)

| TEMP. (°C) | RESISTANCE (KΩ) |
|---|---|
| 110 | 9.574 |
| 115 | 8.234 |
| 120 | 7.109 |
| 125 | 6.154 |
| 130 | 5.347 |
| 135 | 4.660 |
| 140 | 4.074 |
| 145 | 3.571 |
| 150 | 3.141 |
| 155 | 2.639 |
| 160 | 2.449 |
| 165 | 2.171 |
| 170 | 1.930 |
| 175 | 1.720 |
| 180 | 1.536 |
| 185 | 1.375 |
| 190 | 1.234 |
| 195 | 1.110 |
| 200 | 1.000 |
| 205 | .9027 |
| 210 | .8166 |
| 215 | .7398 |

FIG. 13(c)

| TEMP. (°C) | RESISTANCE (KΩ) |
|---|---|
| 220 | .6716 |
| 225 | .6104 |
| 230 | .5559 |
| 235 | .5067 |
| 240 | .4627 |
| 245 | .4230 |
| 250 | .3873 |

| |
|---|
| FIG. 16(b)-1 |
| FIG. 16(b)-2 |
| FIG. 16(b)-3 |
| FIG. 16(b)-4 |

| |
|---|
| FIG. 16(c)-1 |
| FIG. 16(c)-2 |
| FIG. 16(c)-3 |

| |
|---|
| FIG. 16(g)-1 |
| FIG. 16(g)-2 |

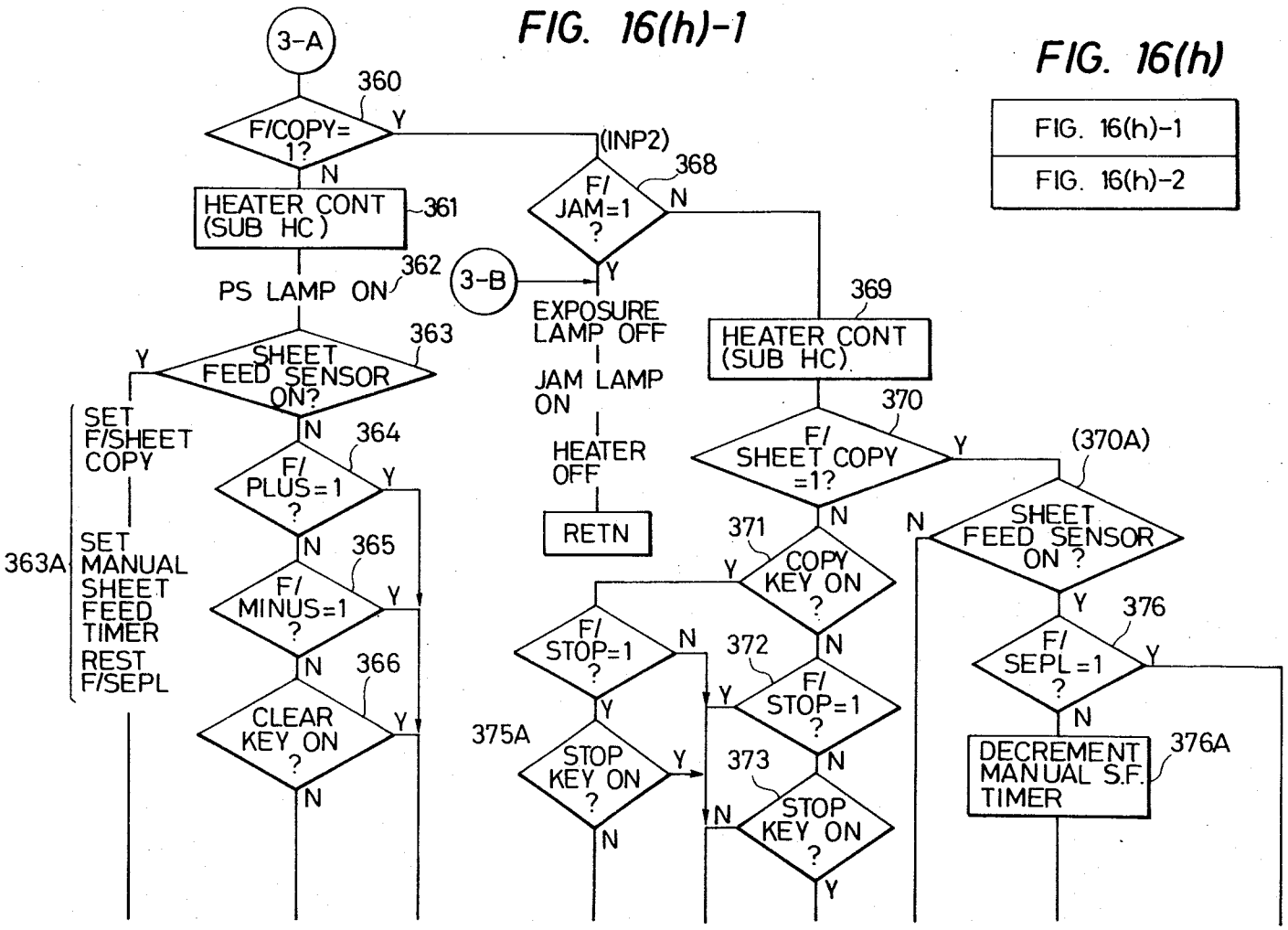
FIG. 16(h)
FIG. 16(h)-1
FIG. 16(h)-2
3-A
360
F/COPY=1?
(INP2)
368
F/JAM=1?
361
HEATER CONT (SUB HC)
362
PS LAMP ON
3-B
EXPOSURE LAMP OFF
JAM LAMP ON
HEATER OFF
RETN
369
HEATER CONT (SUB HC)
363
SHEET FEED SENSOR ON?
363A
SET F/SHEET COPY
SET MANUAL SHEET FEED TIMER
REST F/SEPL
364
F/PLUS=1?
365
F/MINUS=1?
366
CLEAR KEY ON?
370
F/SHEET COPY =1?
(370A)
SHEET FEED SENSOR ON?
371
COPY KEY ON?
372
F/STOP=1?
373
STOP KEY ON?
375A
F/STOP=1?
STOP KEY ON?
376
F/SEPL=1?
376A
DECREMENT MANUAL S.F. TIMER
Y
N

RECORDING APPARATUS

BACKGROUND OF THE INVENTION

1. Field of the Invention

The present invention relates to a recording apparatus for image recording.

2. Description of the Prior Art

Conventional recording apparatus such as copier or laser beam printer have generally been equipped with plural indicators, for example an indicator for the absence of recording sheets, an indicator for sheet jamming in addition to a 7-segment indicator unit for recording the number of image recordings. The presence of such plural indicators not only complicates the inspecting work of the operator but also requires a larger space for installation, thus leading to a complicated apparatus.

Also, in the field of recording apparatus, there have been proposed various jam detectors for detecting abnormal transportation of recording sheets, mostly relying on electric timers. Such detectors often suffer from changes in working time due to deterioration of performance in electric components after prolonged use, and sometimes require the use of particular electric timers.

Digital computers employed for controlling the recording apparatus are designed to be automatically reset and start function from a determined step according to predetermined program at the start of power supply. Such computers may perform erroneous operation in case data reading has to be done at the start of operation, since such data reading is conducted during the initial unstable state of the power supply.

Control of a recording apparatus by the output of an oscillating circuit of a determined frequency is quite well known. Such controller method is however not precise enough due to fluctuation or time-dependent change of performance in the components constituting oscillating circuit, and is costly because of a large number of components involved in such oscillating circuit.

In a recording apparatus equipped with a mechanism for manual sheet insertion, the sheet feeding into the apparatus is effected at a determined timing after the detection of sheet insertion. Consequently, even if the sheet is pulled out immediately after it is inserted, the sheet feeding mechanism is activated to cause a wasteful operation of the recording apparatus.

In a recording apparatus, for example a copier in which the original document performs reciprocating motion, it is already known, for controlling the forward and backward motion of the original document, to activate a timer in response to the detection of the start of forward motion of an original carriage and to invert the moving direction upon expiration of a determined period measured by said timer. Such controlling method is however incapable of achieving exact inversion due to fluctuation in the performance of the timer or other components.

In a recording apparatus for information recording on a recording sheet, the feeding of the recording sheet is started from a determined position when a scanning unit for scanning the original document reaches a determined position, in order to record the image in a proper position on the recording sheet. However a slight error in sheet positioning is unavoidable if the recording sheets are to be fed to said determined position from plural supply sources, such as a sheet cassette and a manual sheet insertion unit.

In a recording apparatus in which an original document is scanned by a scanning unit, it is already well known to obtain a trigger signal or a timing signal required for controlling the apparatus in the course of movement of said scanning unit. Plural trigger or timing signals, if required, may be obtained from plural sensors provided for detecting the movement of said scanning unit. Such method however requires a large number of sensors according to the number of desired signals, thus inevitably leading to a complicated structure.

Recent control of recording apparatus with a microcomputer has enabled various functions of self-diagnosis and abnormality detection. However the increasing number of indicators required for indicating thus detected abnormalities not only complicates the inspecting work of the operator but also leads to a larger space for installation of such indicators and a complicated mechanism.

Temperature control, for example for the fixing device of a copier, has generally been achieved by terminating the waiting mode when said fixing device reaches a determined target temperature and performing on-off control of a heater. Such control method is however associated with a long waiting time because the possible temperature overshooting precludes the use of a high-power heater. In order to overcome such drawback, it is also proposed to employ a detecting point lower than the target control temperature in combination with a high-power heater and to terminate the waiting mode when the temperature reaches said detecting point, thereby reducing the waiting time. In such method, however, the timing for terminating the waiting mode is difficult to determine since the temperature control is effected independently from the initial temperature state of the fixing device. More specifically, the state of temperature rising of the fixing device varies according to the initial temperature thereof. Consequently, if the temperature rise is slow, the fixing device may not reach the target control temperature when the actual fixing operation is needed, after passing the aforementioned detecting point.

In order to detect the failure of a temperature control element such as a thermistor, it is already known to inspect the change in resistance after the lapse of a determined period and to identify a failure in case of the absence of change in resistance. Such control method may lead to overheating of the heater if the power supply is manually turned on and off repeatedly before the lapse of said determined period.

Also in a temperature control method utilizing the change in resistance of a temperature control element such as a thermistor, a precise temperature control in a particular range is difficult to achieve because of the temperature-resistance characteristic of such thermistor and of the narrow dynamic range of the analog-to-digital converter receiving the resistance-indicating signal from the thermistor. Besides said narrow dynamic range is the cause of inability for detecting an abnormally high temperature of the heater controlled by said thermistor.

Furthermore, there are already known various methods for detecting the failure of thermistor or halogen heater, but such methods cannot be utilized for detecting abnormalities including those in the driving circuits for such thermistor and halogen heater.

Conventional copier or laser beam printer is usually equipped with various indicators such as those for indicating the copy number and for indicating sheet jamming, and various operating means such as a copy switch and numeral keys, and requires a very complicated operations for an unskilled operator. Thus, in case the apparatus interrupts the recording operation in response to the detection of absence of recording sheet, the operator may misunderstand such interruption as the end of a series of recording operations and renew the setting of the copy number with the numeral keys.

Furthermore, in a conventional recording apparatus with a sheet feeding mechanism, such as a copier or a laser beam printer, the absence of recording sheet is indicated as soon as the sheets run out. However an unskilled operator may turn off the power supply immediately in such situation, and such premature turning off results in insufficient cleaning of the photosensitive drum thus leaving an unnecessary charge on the drum and causing unevenness in the reproduced image thereafter.

SUMMARY OF THE INVENTION

A prime object of the present invention is to provide a recording apparatus not associated with the above-mentioned drawbacks.

Another object of the present invention is to provide a recording apparatus capable of reducing the number of indicators by utilizing a record number indicator also for other purposes and still allowing said indicator to easily return to the function of record number indication.

Still another object of the present invention is to provide a recording apparatus capable of generating signals required for sheet jamming detection by the movement of a scanning unit.

Still another object of the present invention is to provide a recording apparatus in which determined control procedure is enabled, at the start of power supply, only after normal data entry is confirmed.

Still another object of the present invention is to provide a control unit for generating control signals by counting signals of a determined frequency, capable of releasing said control signals regardless of a change in said frequency, for example from 50 Hz to 60 Hz.

Still another object of the present invention is to provide a recording apparatus capable of avoiding wasteful recording operation.

Still another object of the present invention is to provide a recording apparatus capable of exact control procedure through the use of a simple structure.

Still another object of the present invention is to provide a recording apparatus capable of exact control of movements of movable members with a limited number of sensors.

Still another object of the present invention is to provide a recording apparatus capable of controlling a feeding control unit for the recording sheet by a timing signal obtained through the movement of a scanning unit when said recording sheet is fed from a determined feeding unit, and controlling said feeding control unit by a signal having a certain relationship with said timing signal when said recording sheet is fed from another feeding unit.

Still another object of the present invention is to provide a recording apparatus capable of performing different controls according to the detection of a detecting unit.

Still another object of the present invention is to provide a recording apparatus in which an indicator performs plural indicating functions.

Still another object of the present invention is to provide a temperature control unit capable of exact temperature control under various temperature states for example of a fixing device.

Still another object of the present invention is to provide a temperature control unit capable of optimum temperature control through the use of a simple structure.

Still another object of the present invention is to simplify the control program in the temperature control utilizing a computer.

Still another object of the present invention is to provide a temperature control unit capable of instantaneously detecting the failure for example of a thermistor through the use of a simple structure.

Still another object of the present invention is to provide a temperature control unit capable of detecting whether a thermistor, for example, is in the failed state or not.

Still another object of the present invention is to provide a temperature control unit capable of precise temperature control.

Still another object of the present invention is to provide a temperature control unit capable of easily detecting an abnormal temperature rise for example of a heater controlled for example by a thermistor.

Still another object of the present invention is to provide a temperature control unit with improved safety.

Still another object of the present invention is to provide a power control device capable of easily detecting an abnormality in a thermistor, a heater or the like and in driving circuits therefor.

Still another object of the present invention is to provide a recording apparatus capable of preventing erroneous operations of the operator.

Still another object of the present invention is to provide a recording apparatus capable of constantly producing stable images.

Still another object of the present invention is to provide a recording apparatus capable of exact sequence control by means of zero-cross pulses.

Still other objects of the present invention will become fully apparent from the following description to be taken in conjunction with the attached drawings and from the appended claims.

BRIEF DESCRIPTION OF THE DRAWINGS

FIGS. 6A and 6B show a wave form chart showing signal on the signal line S2 shown in FIG. 4, wherein (a) and (b) respectively correspond to 50 Hz and 60 Hz;

FIGS. 7A and 7B show a wave form chart indicating signals in an abnormal situation, wherein (a) and (b) indicate signals respective on the signal lines S1 and S2 shown in FIG. 4;

FIG. 10 is a chart showing the relationship between output ports of the control unit and various loads shown in FIG. 4;

FIGS. 12(*a*) to 12(*c*) are charts showing the relationship between the resistance of a thermistor connected in parallel with a resistor and the analog-to-digital converted value;

FIGS. 13(*a*) to 13(*c*) are charts showing the relationship between the temperature and the resistance of a thermistor;

FIGS. 17, 17-1 and 17-2 show timing charts showing the functions of various components of the copier; and FIGS. 18-1 and 18-2 show control flow charts showing another embodiment.

DETAILED DESCRIPTION OF THE PREFERRED EMBODIMENTS

Now the present invention will be clarified in detail by an embodiment thereof shown in the attached drawings.

Figure 1:
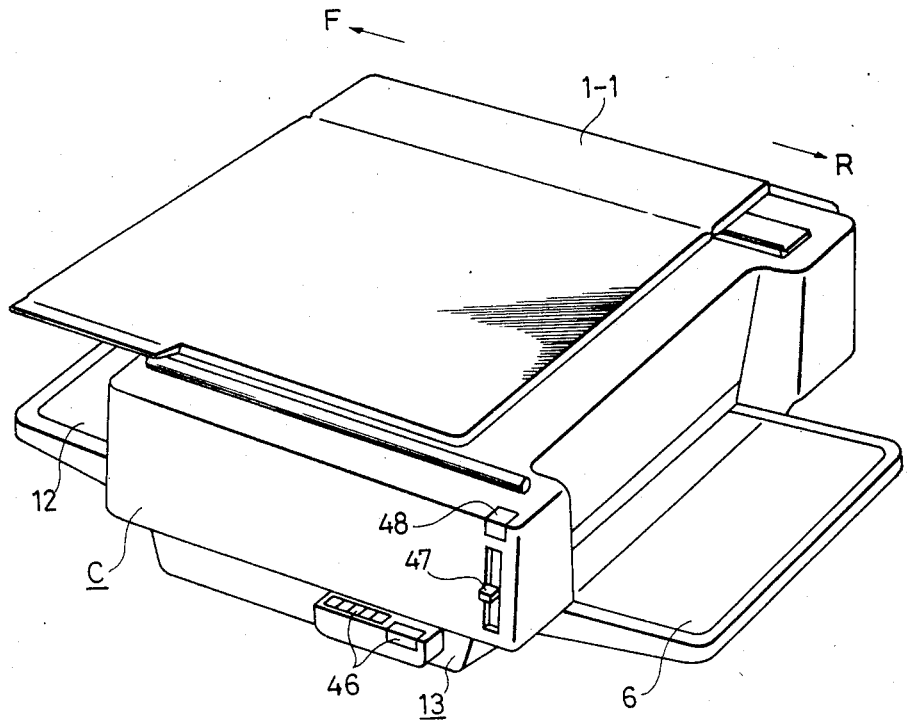
FIG. 1 is a perspective view of a copier embodying the present invention.
Figure 2:
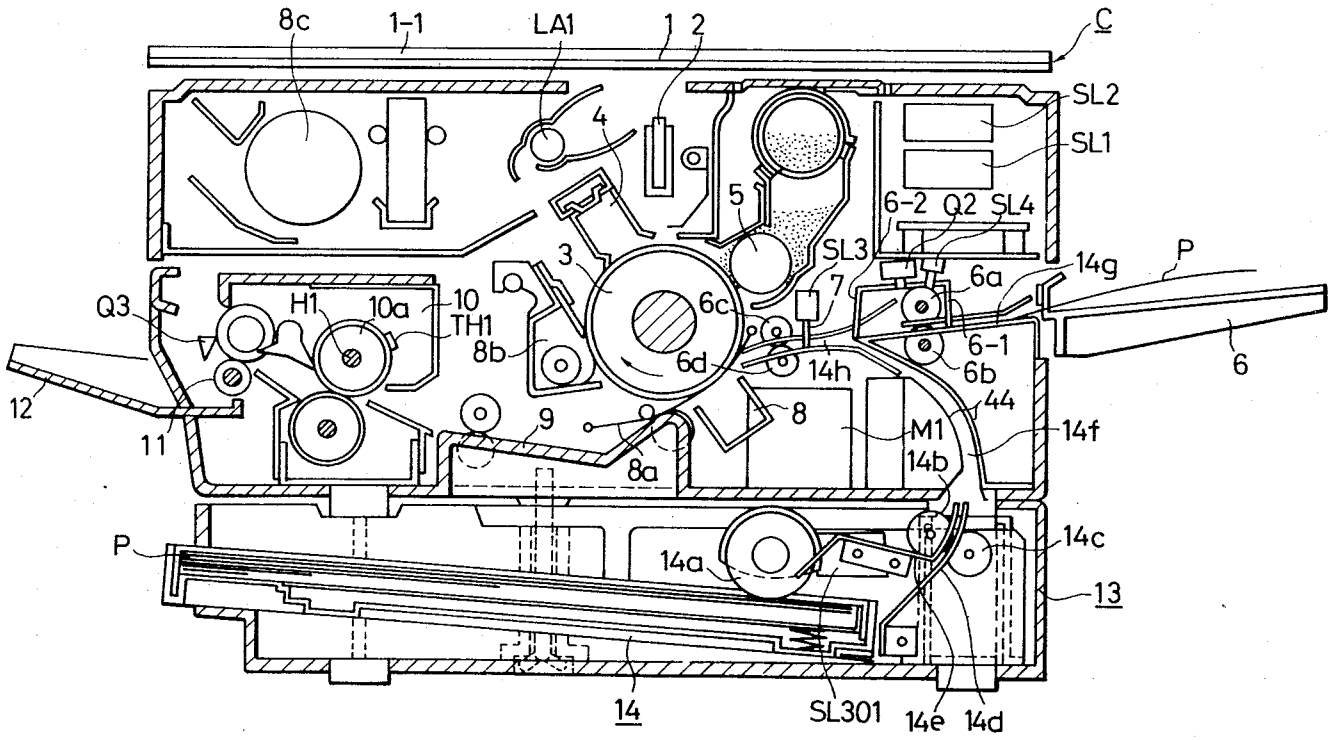
FIG. 2 is a cross-sectional view of the copier shown in FIG. 1.
Figure 3A:
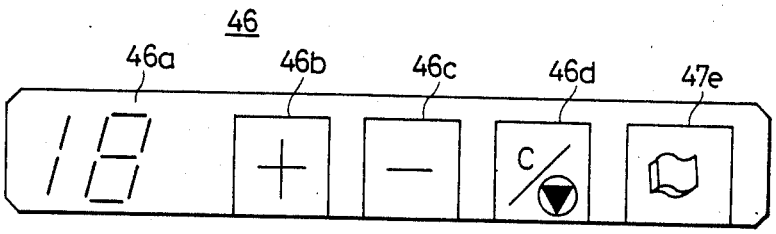
FIG. 3A and FIG. 3B show schematic views of a display unit and an operation unit, wherein (a) is a plan view of a display unit provided on a cassette, while (b) is a plan view of a display unit provided on the copier.
Figure 3B:
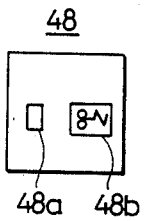

FIGS. 1 and 2 are a perspective view and a cross-sectional view, respectively, of a copier in which the present invention is applicable. An original document plate 1, composed of a transparent member, is provided thereon with a pressure plate 1-1 for holding the original document on said plate 1, and performs reciprocating motion, together with said pressure plate 1-1, in a forward direction (arrow F) and a reverse direction (arrow R). An array 2 of short-focus imaging elements of a small diameter is provided to expose, in a slit shape, a seamless photosensitive drum 3 to the image of said original document which is placed on said plate 1 and illuminated by a halogen lamp LA1. A charger 4 provides said photosensitive drum 3 with uniform charge. The drum 3, thus uniformly charged, is then subjected to the imagewise exposure by the imaging element array 2 to generate an electrostatic latent image corresponding to the original image. Said electrostatic latent image is then rendered visible by a developing unit 5. Said seamless photosensitive drum, developing unit and charger are so constructed as to be integrally detachable from the apparatus. A recording sheet P, manually supplied from a manual feed tray 6, is advanced by the lowering or a constantly driven feed roller 6*a* toward an idler roller 6*b* when a manual sheet feed solenoid SL4 is energized in response to a signal from a sheet feed sensor Q2 for detecting such manual feeding. Said sensor Q2 is driven by detecting arms 6-1, 6-2 extending in front of and behind the sheet feed roller 6*a* and is activated either of said arms is lifted by the sheet. The front end of the advancing sheet is stopped by a registering shutter 7 which normally is positioned to close a sheet feed path 14*h*. When the front end of the sheet is stopped in this manner, the sheet no longer advances due to slippage between the rollers 6*a* and 6*b*, and the manual sheet feed solenoid SL4 is soon deactivated thereafter. Subsequently, said solenoid SL4 is energized again, and, in response to a registering signal supplied to a registering shutter solenoid SL3, the shutter 7 is lifted upwards to restart the transportation of the sheet, which thence is advanced towards the photosensitive drum 3 by means of constantly driven rollers 6*c*, 6*d*.

Then the toner image on the photosensitive drum 3 is transferred onto the recording sheet P by means of a transfer charger 8. The recording sheet P then separated from the drum 3 by means of a separating belt 8*a* is guided by a guide 9 to a fixing device 10, in which the toner image on the sheet P is fixed by a fixing roller 10*a* incorporating a halogen heater H1, and is discharged onto a tray 12 by a discharge roller 11.

An optical or mechanical sheet discharge sensor Q3 releases a detection signal upon detection of a sheet. A thermistor TH1 is provided to detect the temperature of the fixing roller in said fixing device 10.

A cleaner 8*b* removes the toner remaining on the drum 3 after the image transfer, thus preparing said drum for re-use. A cooling fan 8*c* is provided for discharging heated air from the casing of the recording apparatus.

The original document plate 1 of the present embodiment is provided thereunder with unrepresented racks, and can be driven in the forward or reverse direction by rotating pinions meshing with said racks. There are provided an original plate stop solenoid SL1 for controlling a reverse clutch and an original plate advance solenoid SL2 for controlling a forward clutch, and the rotation of a motor M1 is transmitted to said pinions either through said forward clutch or reverse clutch to control the movement of the original document plate.

In a part of the main body there are provided two microswitches MS3, MS4 facing the original document plate 1, and cams are fixed to said plate 1 in such a manner as to engage with said microswitches.

Figures 14A, 14B, 14C, 14D, 14E, 14F, 14G, 14H:
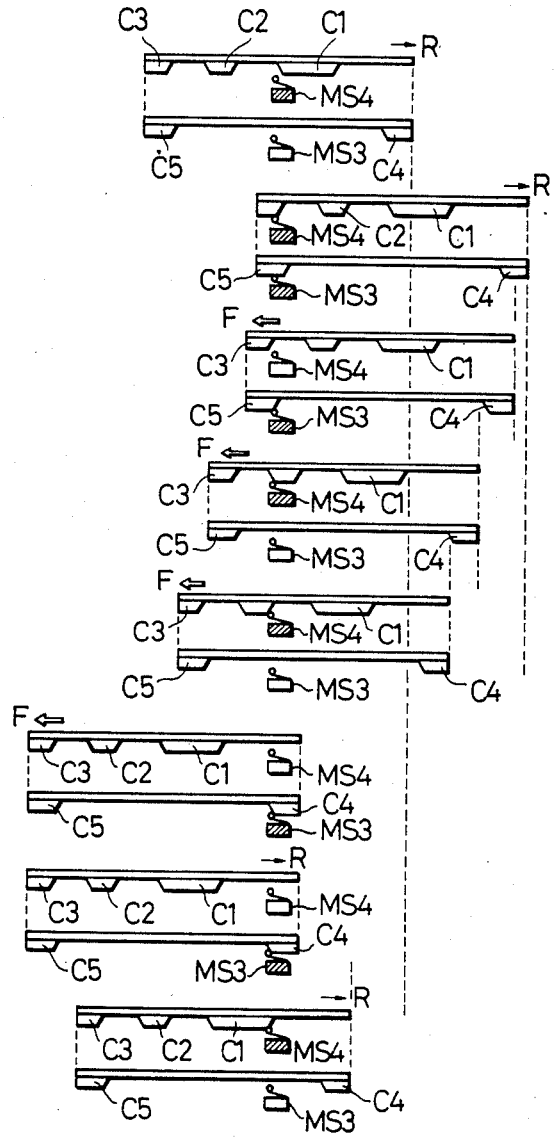
FIGS. 14*a* through 14*h* show charts showing the cam arrangement and the microswitch operation.

FIG. 14 shows the arrangement of said cams and the function of the microswitches. Corresponding to the microswitch SW3 there are provided a reversing cam C4 and a start position cam C5, while corresponding to the microswitch MS4 there are provided a home position cam C1, a registering cam C2 and a start position cam C3. Referring to (a) to (h) in FIG. 14, at the start of the reversing motion (direction R) of the original plate as shown in (a), the microswitch is turned off, as being freed from the cam C1, to energize the original plate stop solenoid SL1 (only at the end of a series of copying operations), thus initiating a check procedure for a stay jamming of the final copy at the discharge exit.

Then, as both microswitches MS3, MS4 are turned on as shown in (b), the original plate stop solenoid SL1 is energized and a check procedure for sheet feeding error is conducted (only in the sheet feeding from a cassette).

Then, with the start of forward motion of the original plate (direction F) as shown in (c), the microswitch MS3 is turned off to energize the manual sheet feed solenoid SL4. Subsequently, when the microswitch MS4 is turned on as shown in (d), the registering shutter solenoid SL3 is energized and the developing bias is changed over according to the position of a copy density lever.

Then, when the microswitch MS4 is turned off as shown in (e), the registering shutter solenoid SL3 is deactivated, the manual sheet feed solenoid SL4 is deactivated, and a check procedure for the stay jamming at the discharge exit in the continuous copying mode is started. This check procedure is not conducted for the final copy.

Subsequently, as the microswitch MS3 is turned on as shown in (f), the original plate advance solenoid SL2 is turned off to invert the moving direction of said plate.

Then, when the microswitch MS3 is turned off as shown in (g), a cassette sheet feed solenoid SL301 is energized for the second sheet and thereafter in case of a continuous copying operation.

Finally, when the microswitch MS4 is turned on as shown in (h), the developing bias voltage is changed to a non-imaging value, and a check procedure for sheet delay jamming at the discharge exit.

In case of a continuous copying operation, the control procedure is repeated again from the step (a).

The copier of the present embodiment is equipped therein, as explained before, with a manual sheet feeding mechanism capable of feeding only one sheet P, but an attachment 13 may be connected to the lower part of the copier C to enable continuous sheet feeding from a cassette 14 in case continuous copying operations on plural recording sheets is required.

Said attachment 13 is provided with a sheet feed rollers 14*a* controlled by the cassette sheet feed solenoid SL301 and constantly driven transport rollers 14*b*, 14*c*, and a feed path constituted by guide members 14*d*, 14*e* is so constructed as to be connected with a feed path 14*f* provided in the main body of the copier.

Said sheet feed path 14*f* and the aforementioned sheet feed path 14*g* for manual sheet feeding both lead to a common feed path 14*h*, in which the registering shutter 7 is positioned to stop the front end of the recording sheet P.

In the attachment 13 there is provided an operation unit 46 including a copy key and an operation/indicator unit. The main body of the copier C is provided with an operation unit including a density control lever 47 and a power/jam indicator unit 48.

Figure 16A:
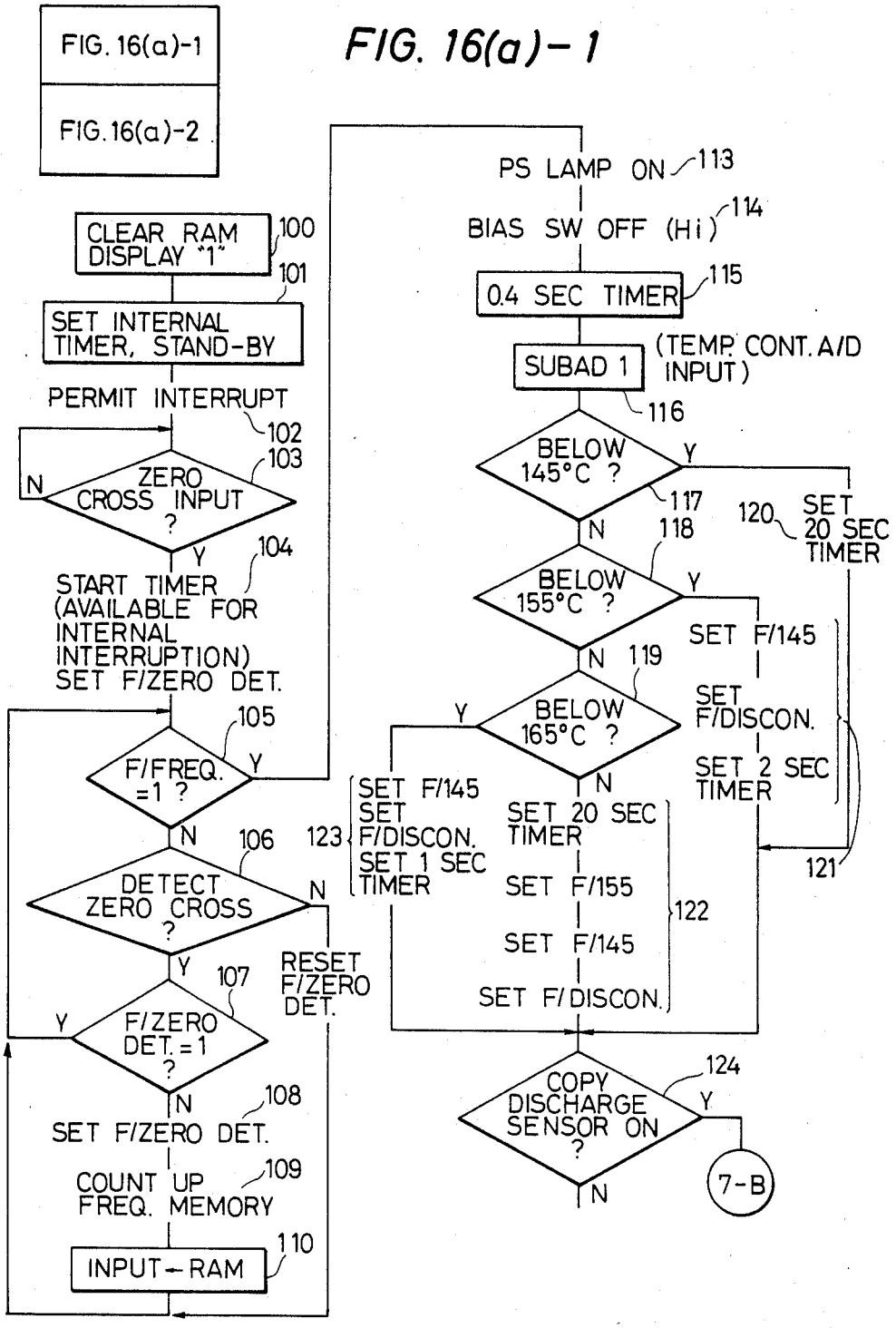
FIGS. 16(*a*) to 16(*h*) are control flow charts.
Figures 2, 16A:
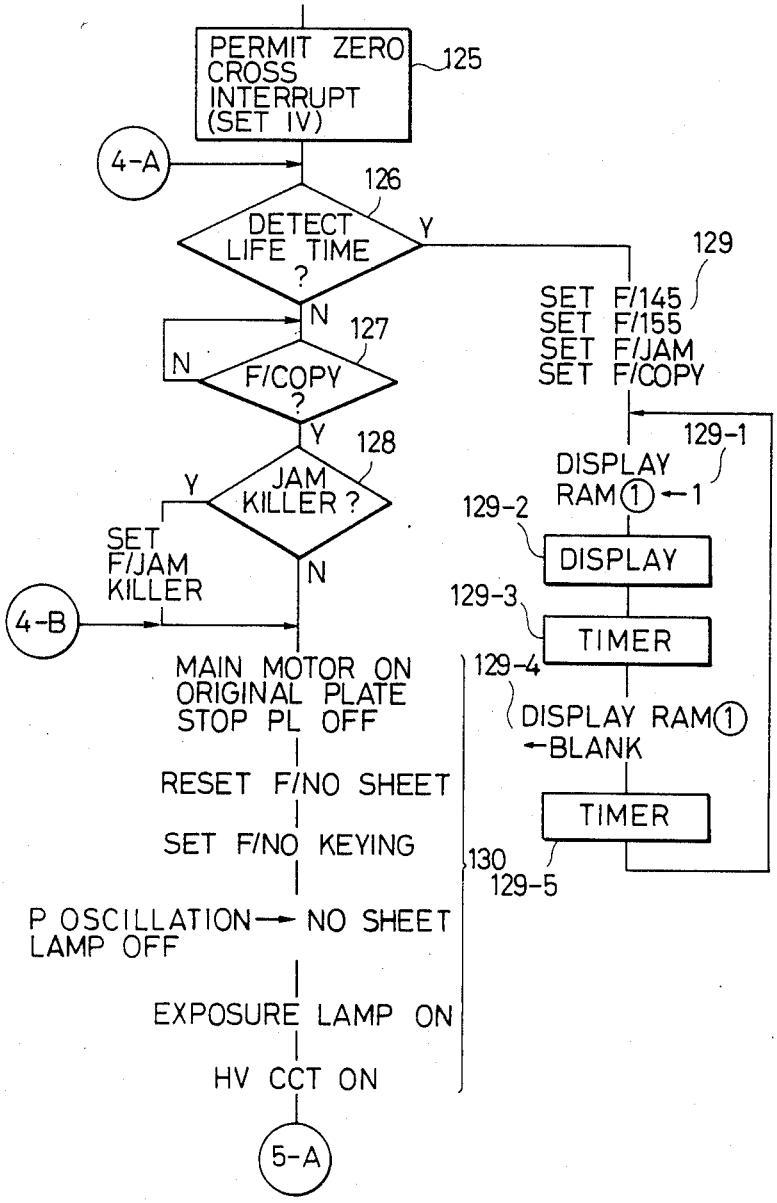
Figures 1, 6B, 16B:
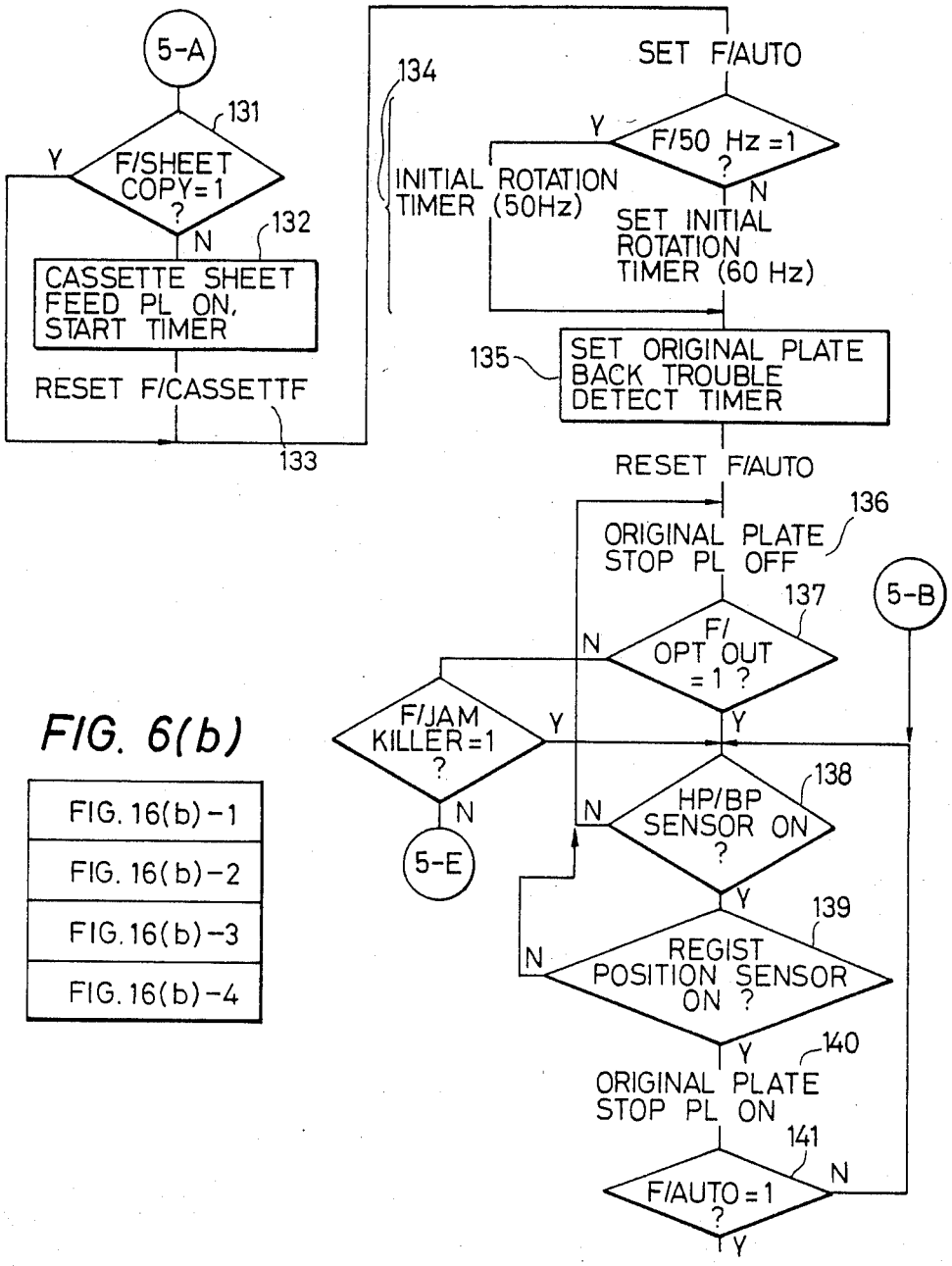
Figures 2, 16B:
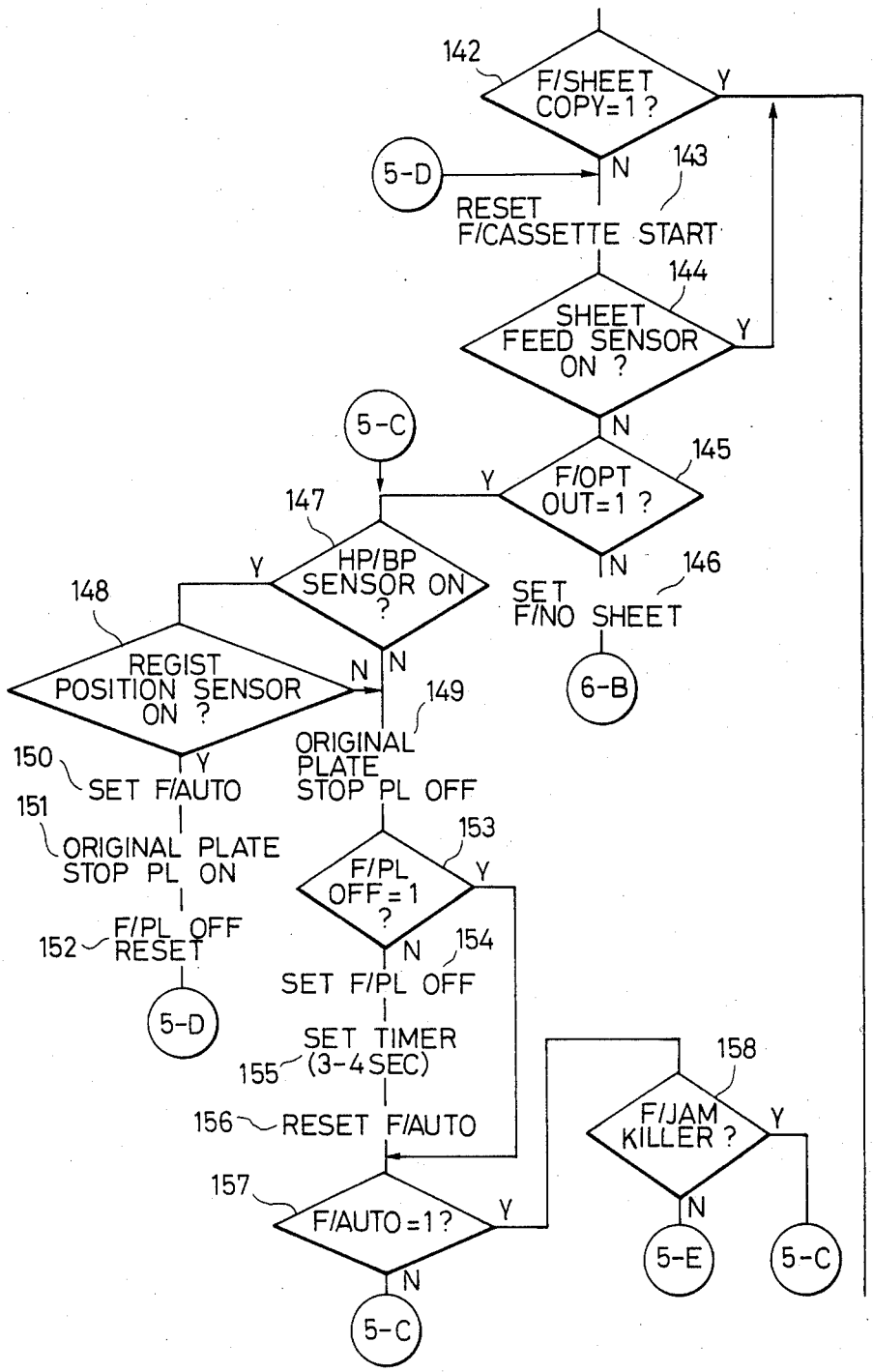
Figures 3, 16B:
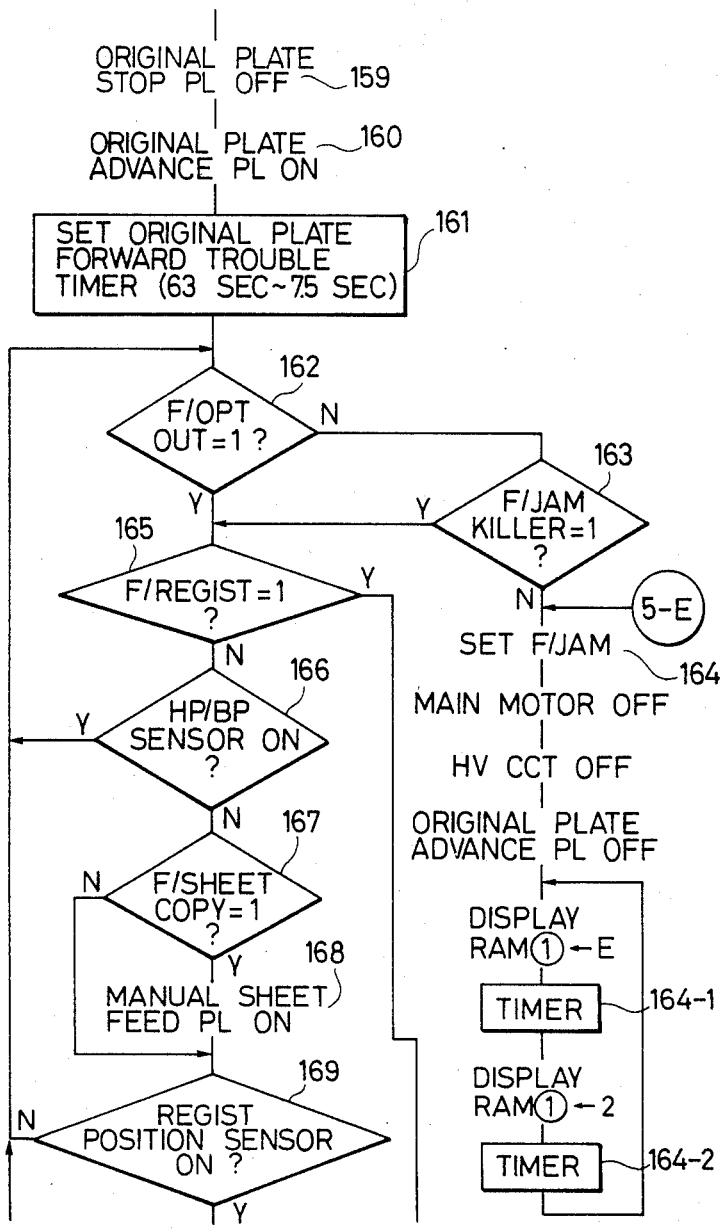

FIG. 3 shows the details of said operation unit 46 and the power/jam indicator 48. As shown in (a), the operation unit 46 is provided with a segment display unit 46*a* for indicating the copy number up to 19 copies and also for flashing a sign "□" in case of absence of sheet or of a sheet feeding error from the cassette; copy number setting keys 46*b* (plus key) and 46*c* (minus key) which stepwise increase or decrease the set copy number at a determined interval when either of said key is continuously actuated; a clear/stop key 46*d* for clearing the set copy number and for interrupting the copying operation in progress; and a copy key 47*e* for starting the copying operation. The power/jam indicator shown in FIG. 3(*b*) is provided with a power indicator lamp 48*a* which is lighted when electric power is supplied to the copier; and a jam indicator 48*b* which is lighted in case of a jamming of the recording sheet. In the present embodiment the use of copy number indicator also for other purposes such as the indication of absence of recording sheet allows to simplify the structure of the operation unit, thus enabling easier operation and a lower production cost.

Figures 4, 16B:
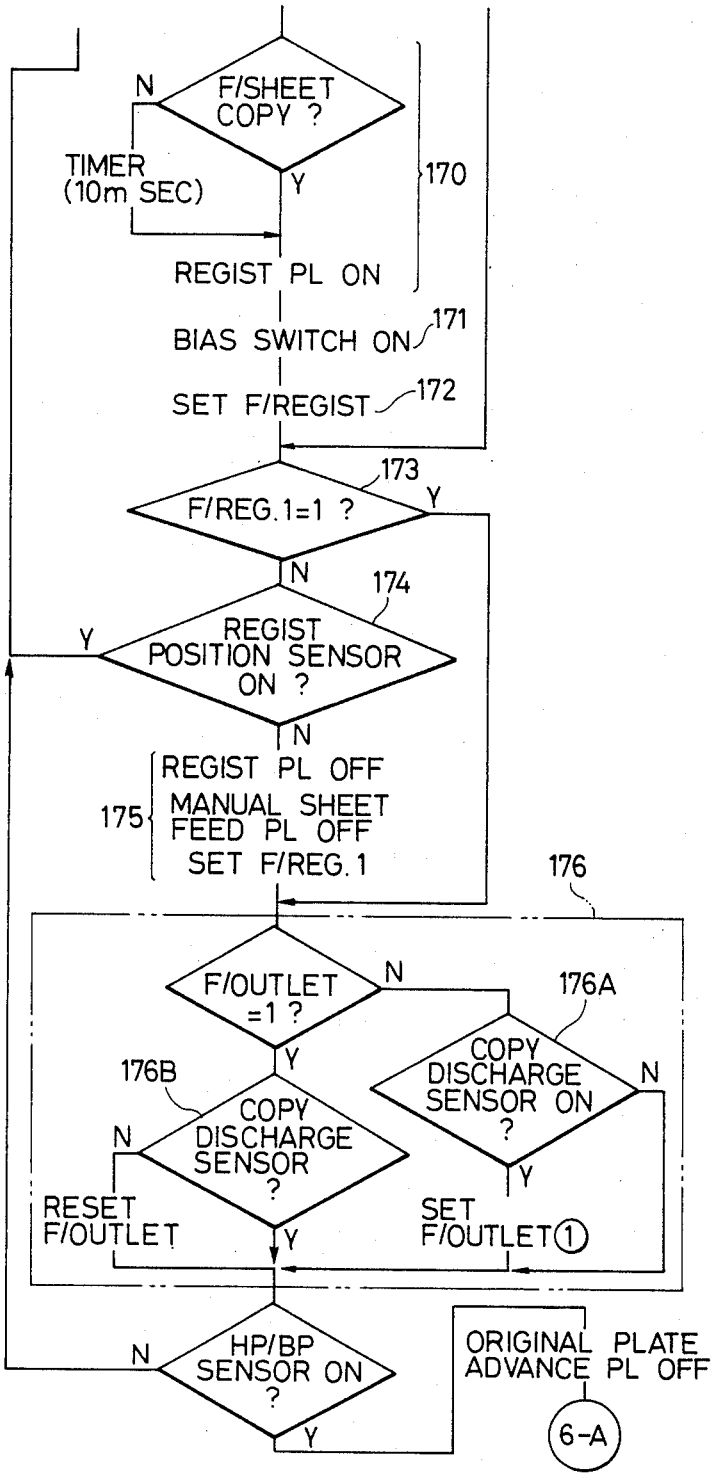
FIG. 4 is a block diagram of a control circuit for use in the copier shown in FIG. 1.
Figures 1, 16C:
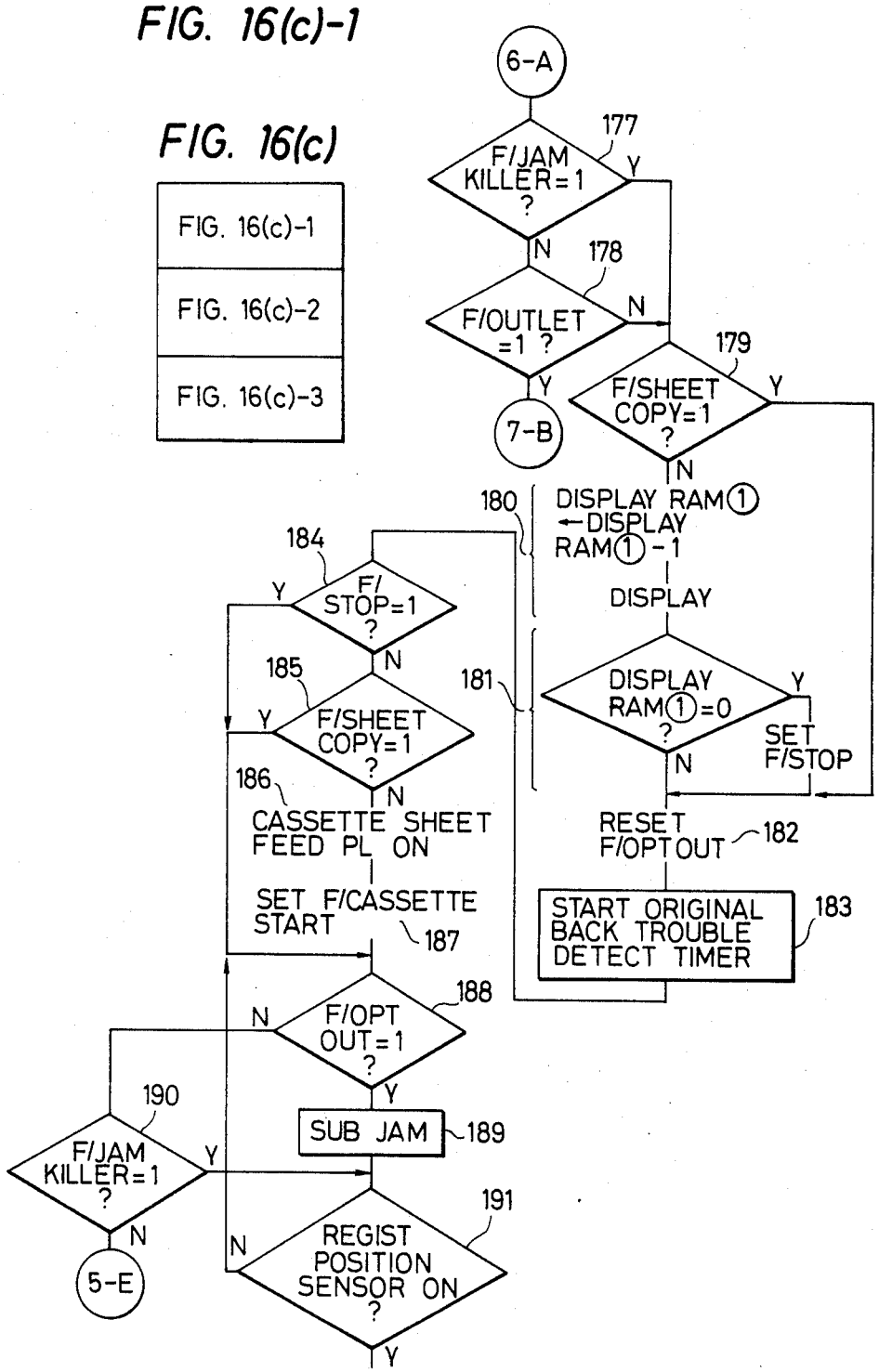
Figures 2, 16C:
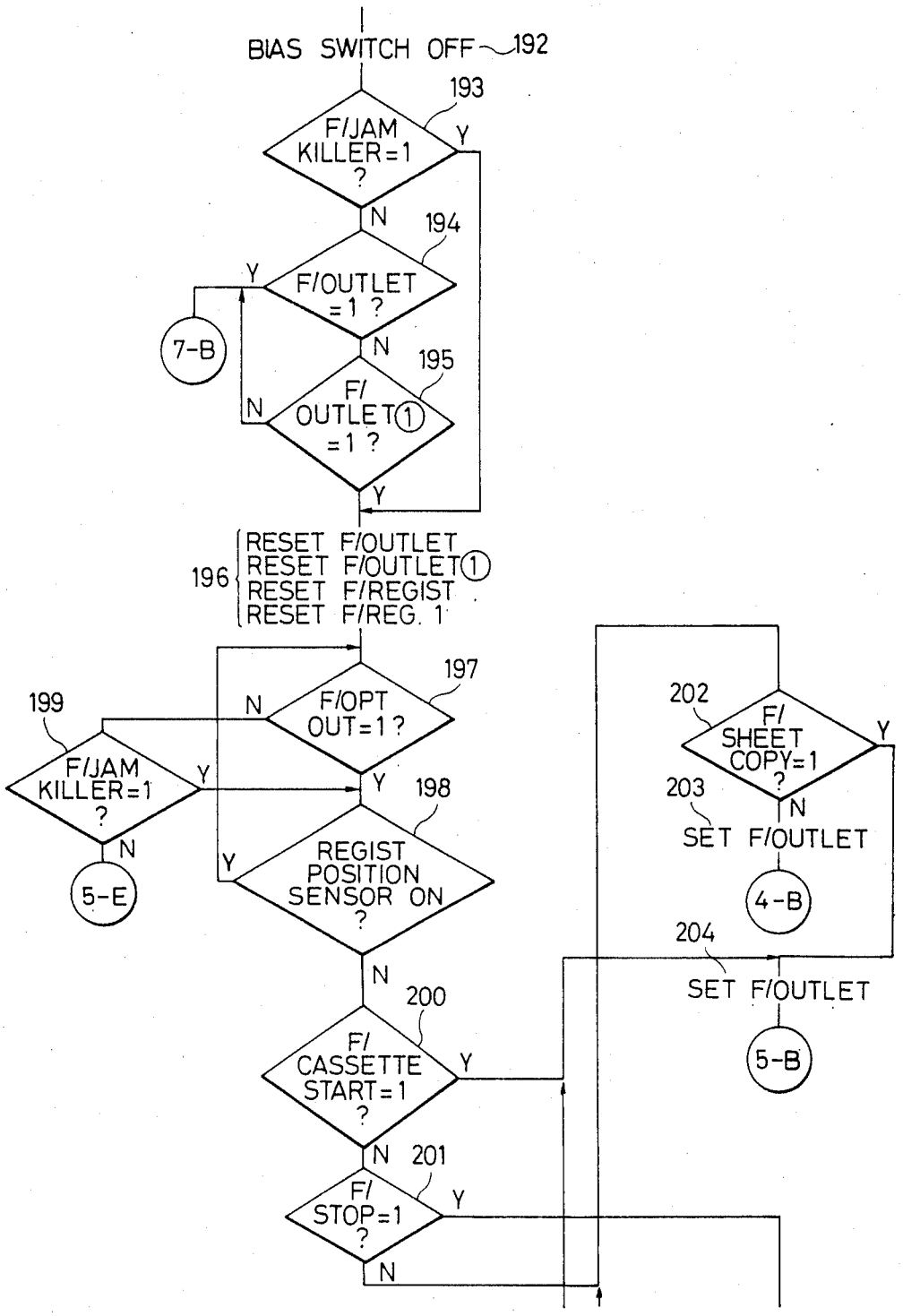
Figures 3, 16C:
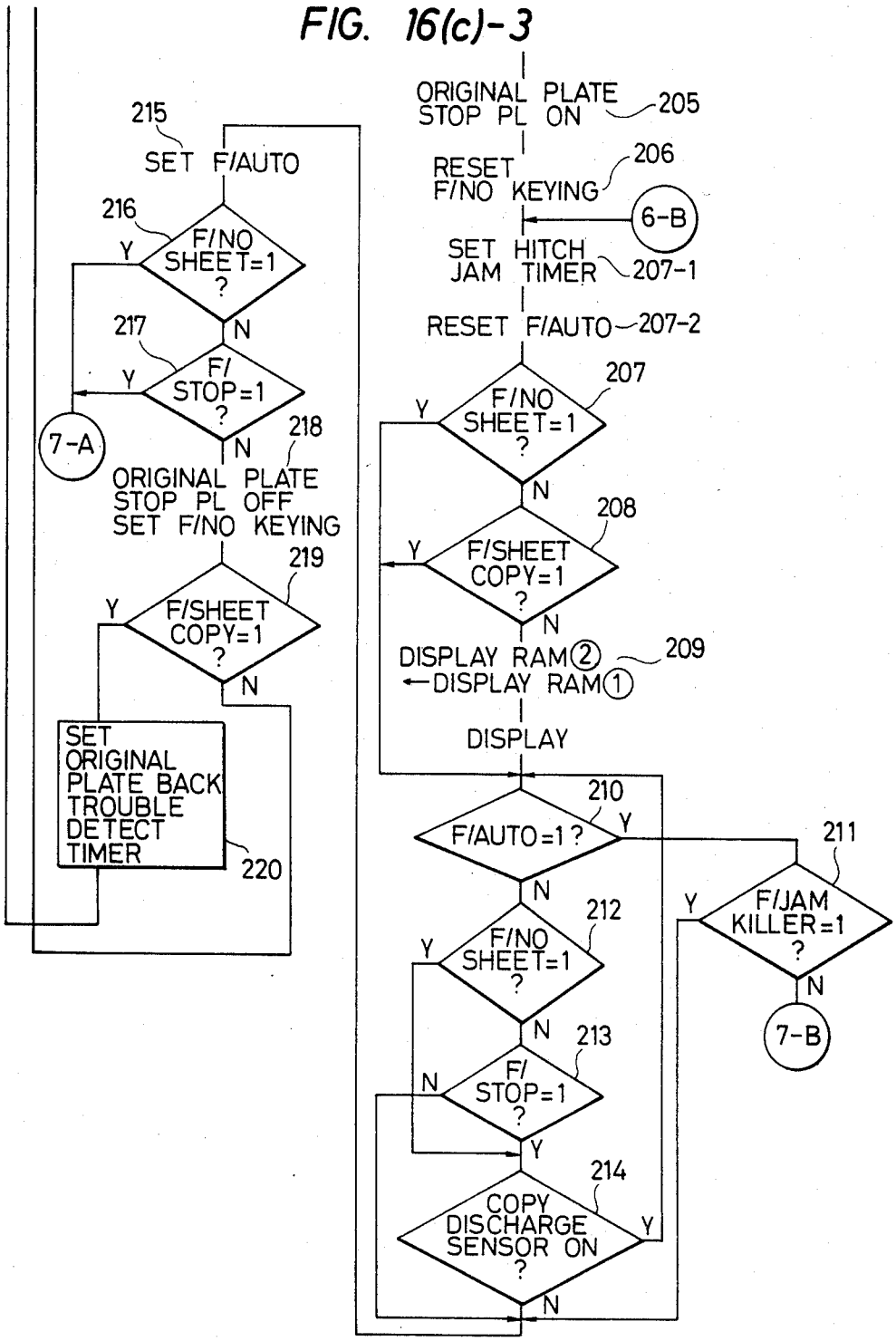
Figure 16D:
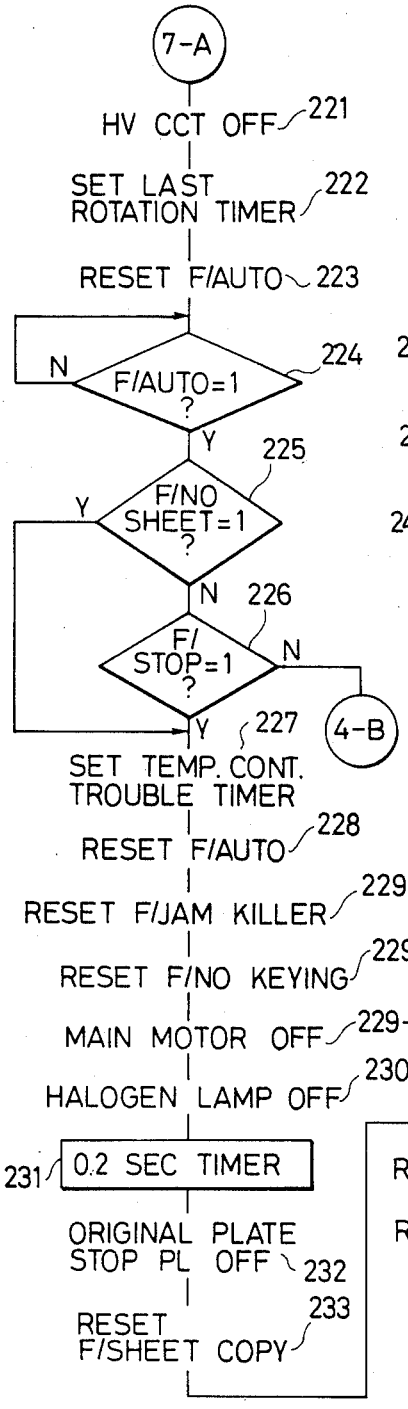
Figure 16E:
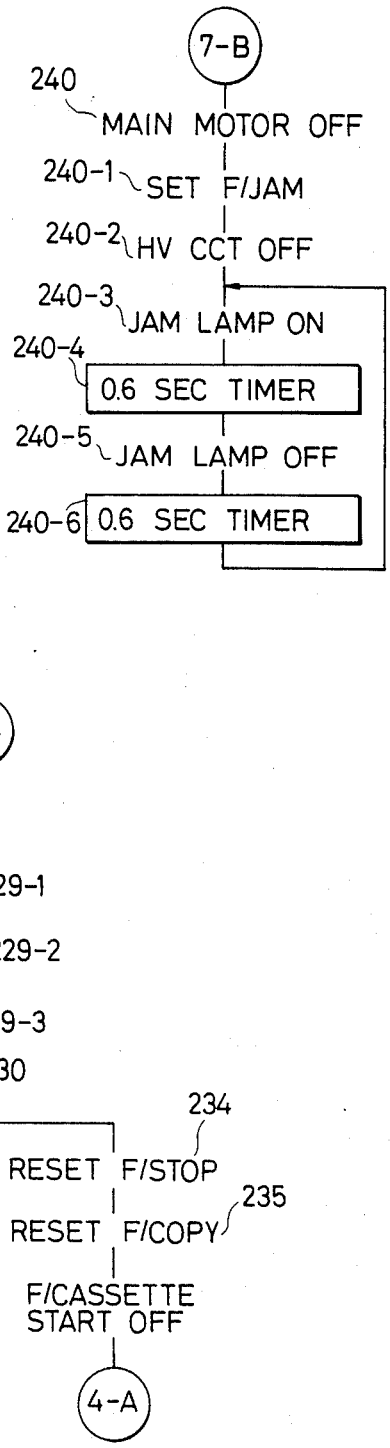
Figure 16F:
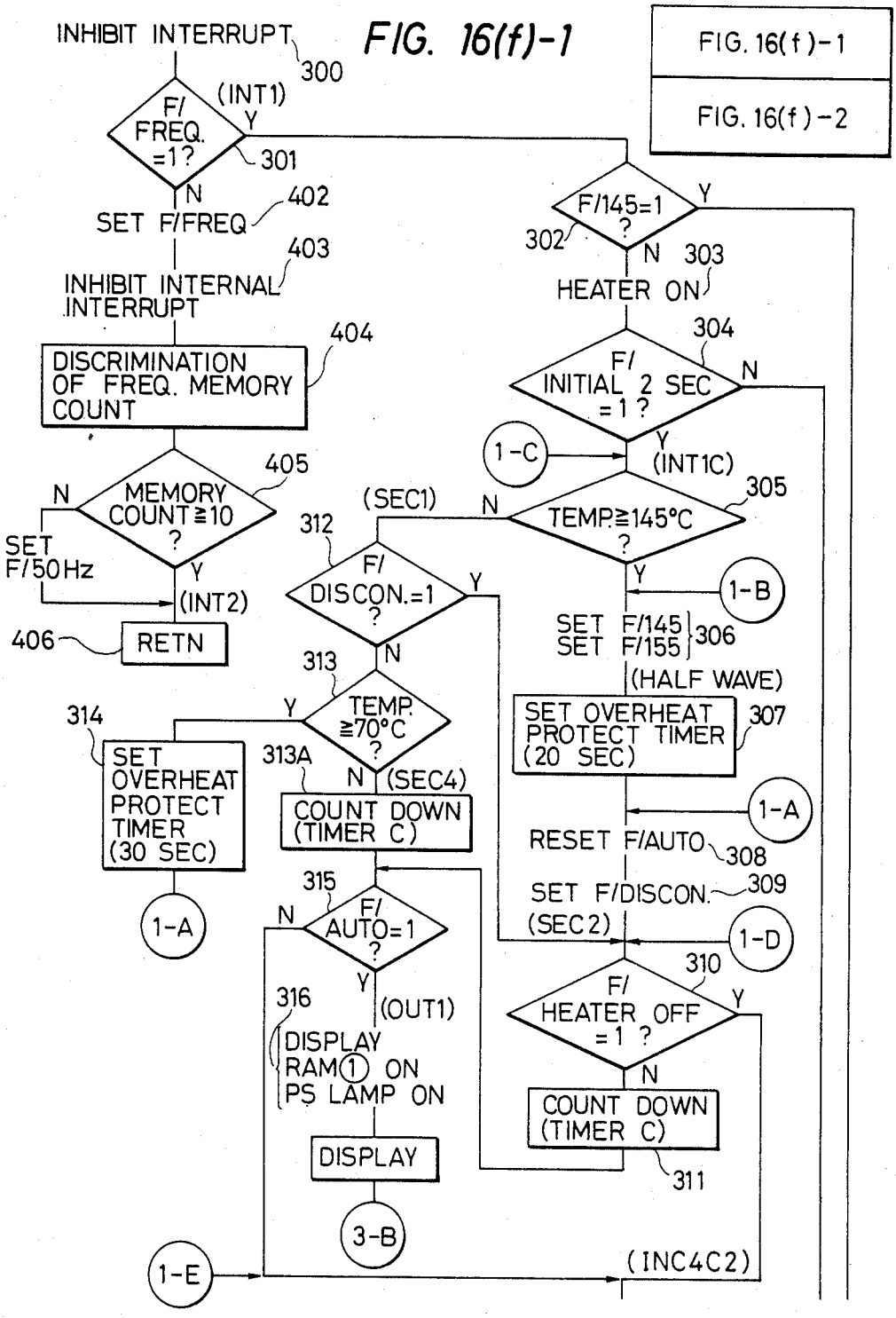
Figures 2, 16F:
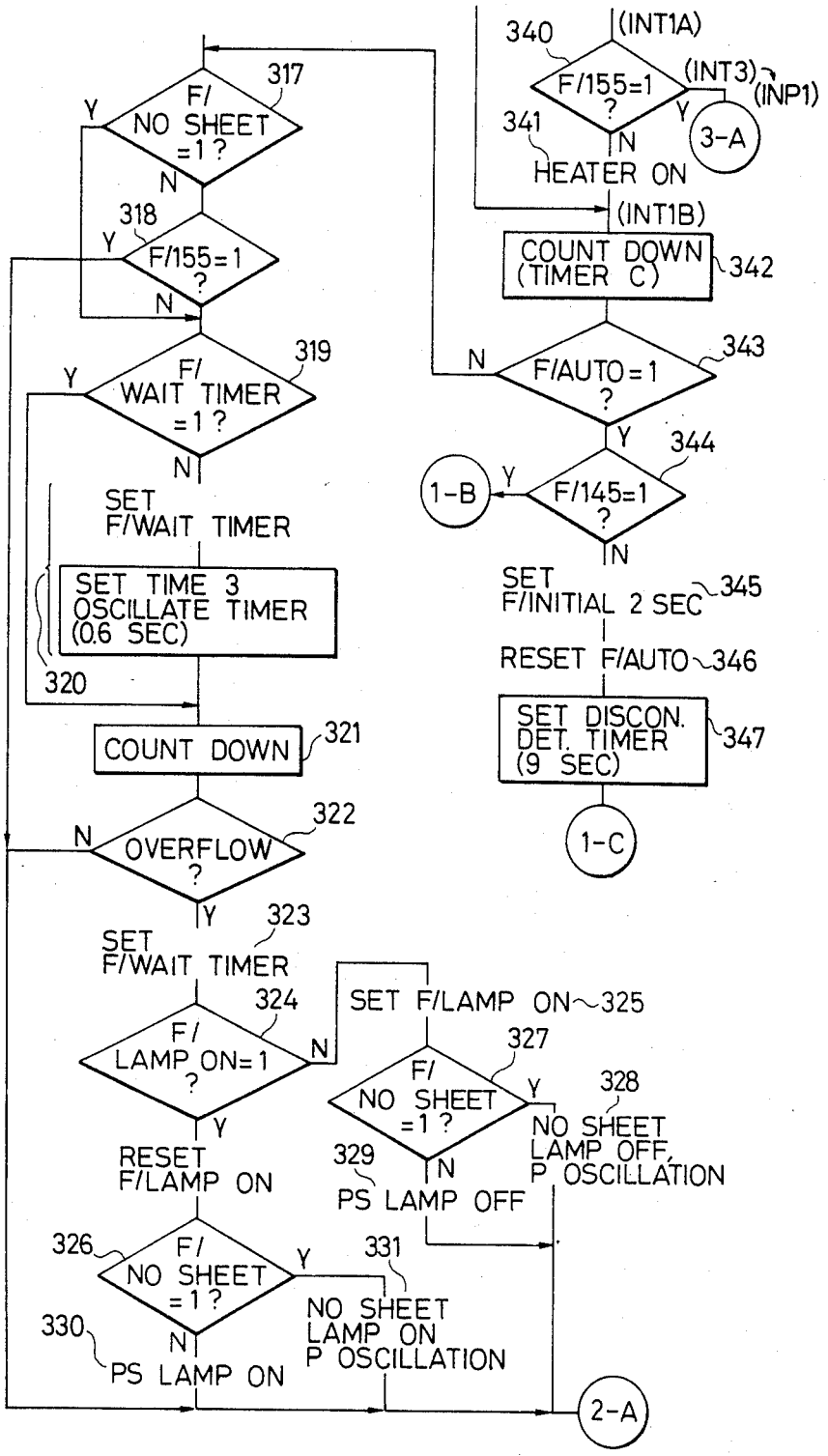
Figures 1, 16G:
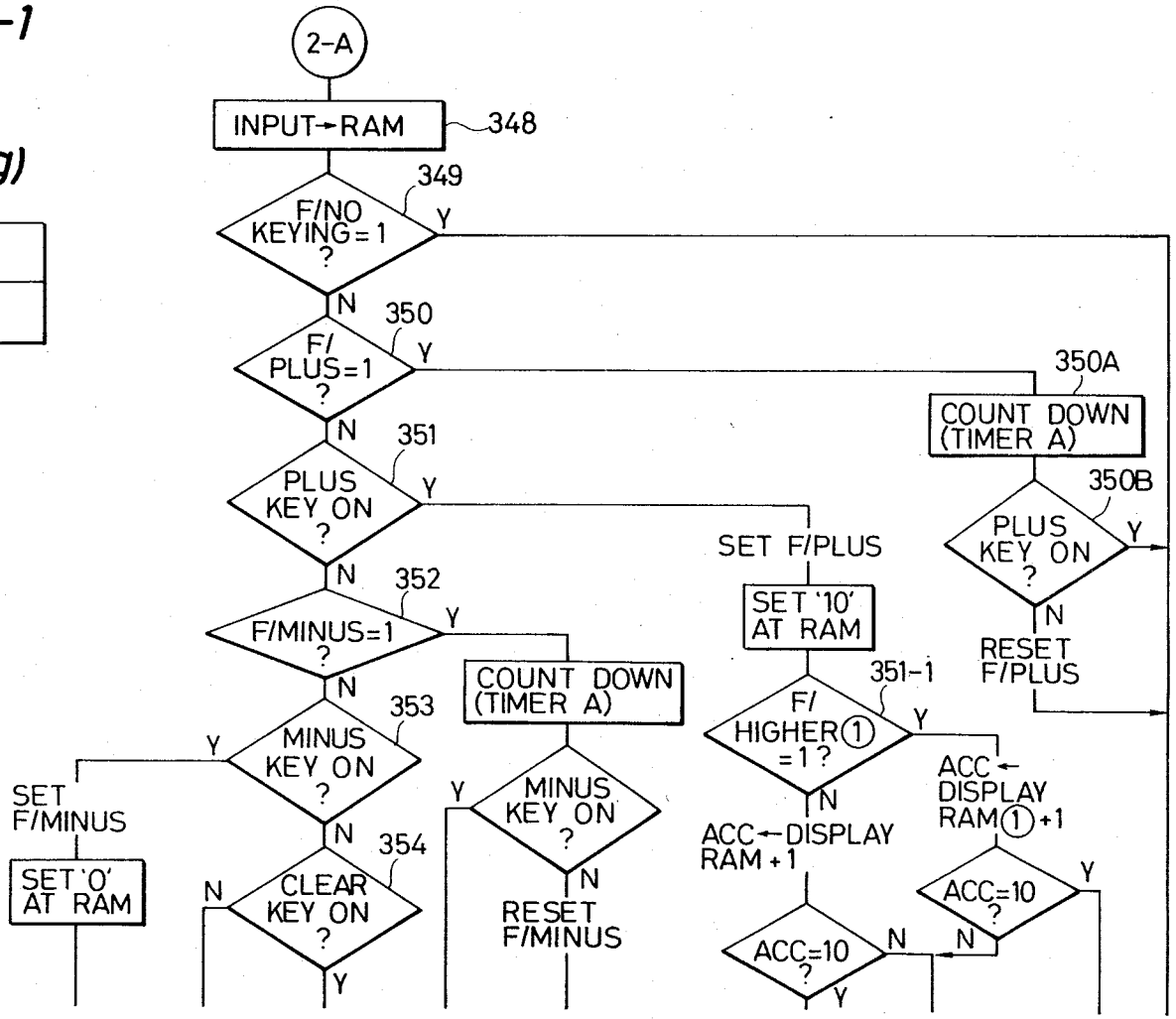
Figures 2, 16G:
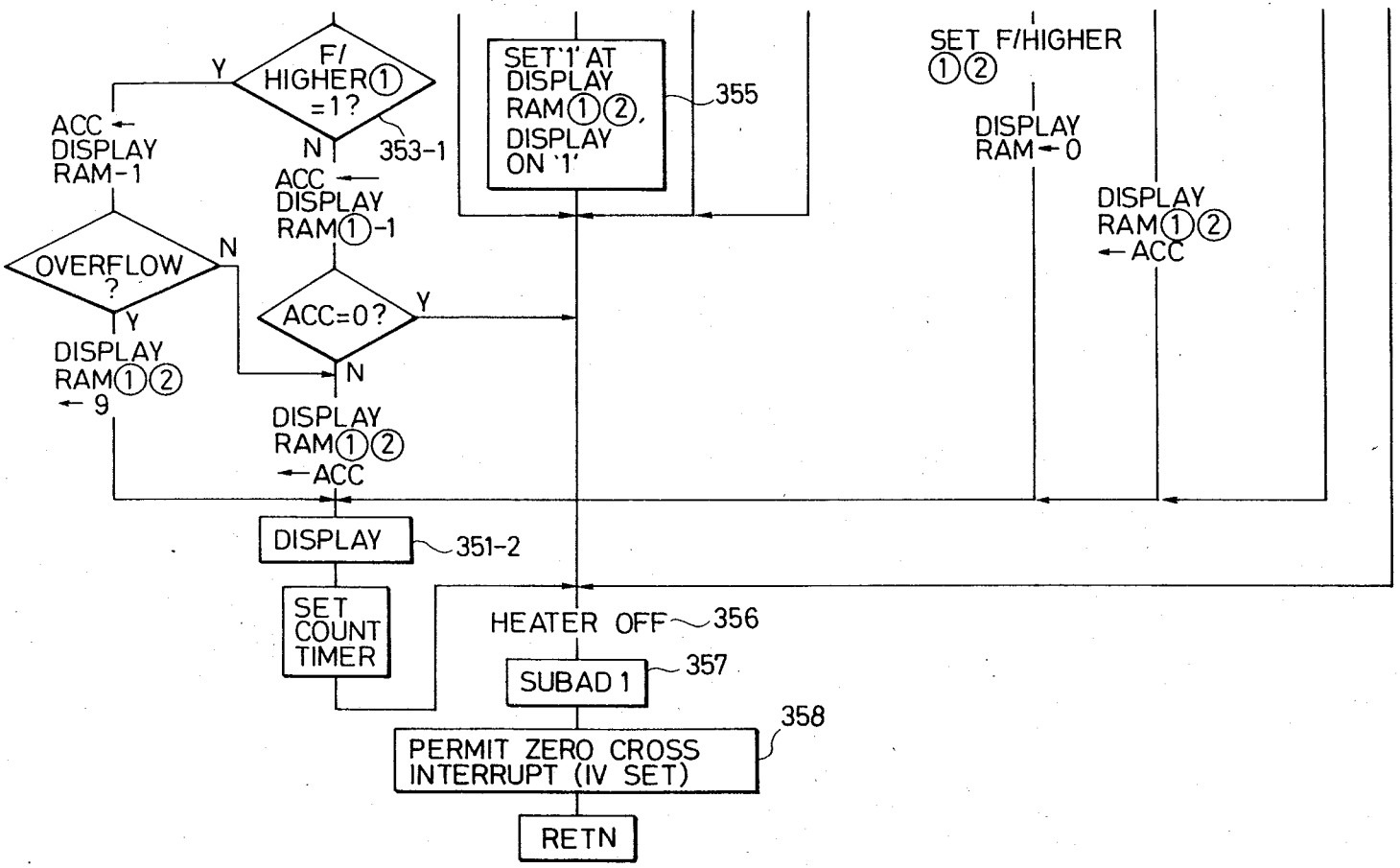
Figures 2, 16H:
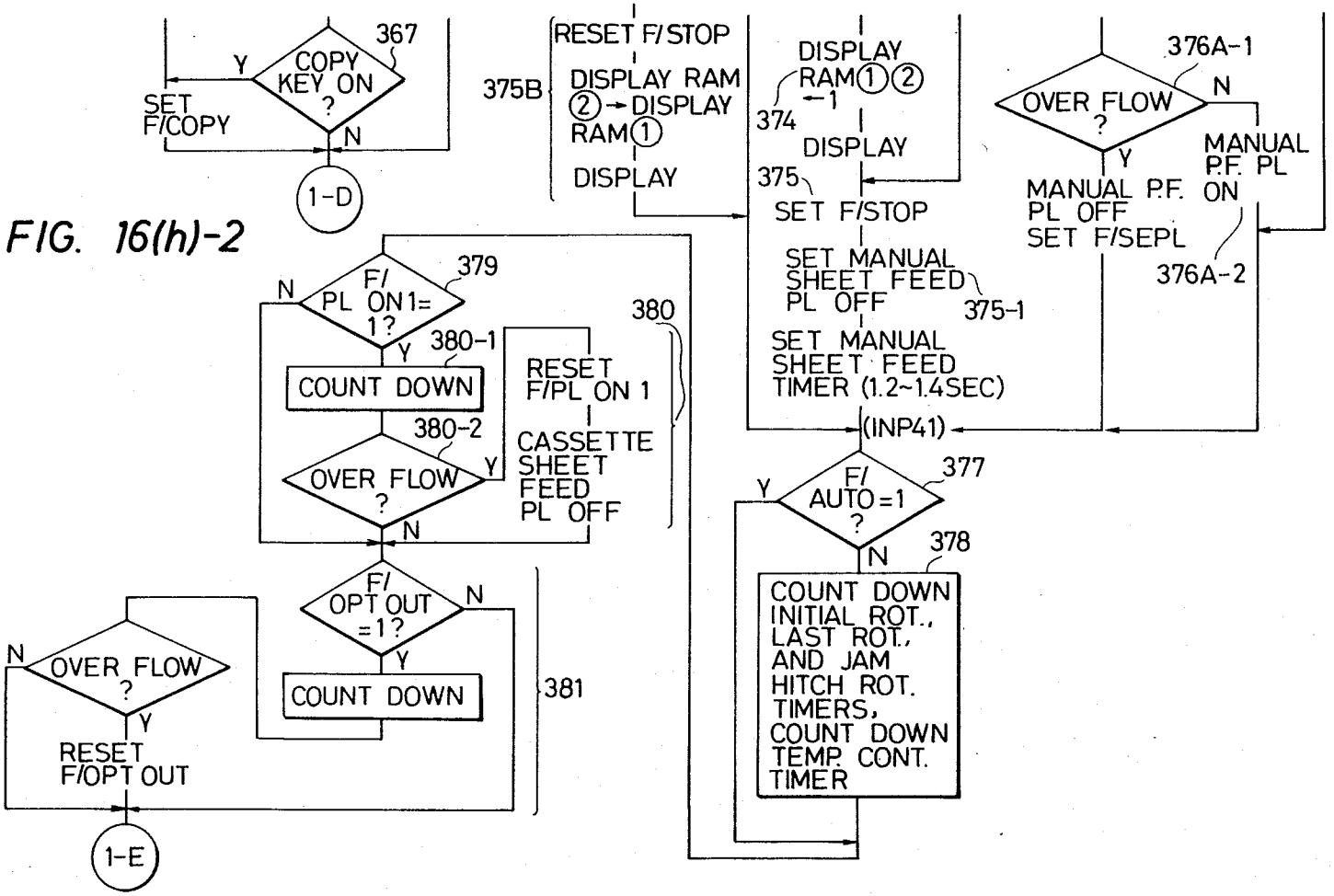

FIG. 4 shows, in a block diagram, a control circuit employed in the copier shown in FIG. 1. A control unit Q203 is composed of an 8-bit microcomputer incorporating an A/D converter, for example an element known as TMS2300 supplied by Texas Instruments Inc. Said A/D converter may naturally be provided outside the control unit Q203, if desirable.

DC power supplies of 24 V and 9 V are obtained from a commercial AC power supply, through a transformer T1 and a power supply circuit 200. The AC power supply is main utilized for driving a main motor M1, a halogen lamp LA1, a halogen heater H1 etc. The DC 24 V power supply is utilized for driving solenoids etc., and DC 9 V power supply is utilized as the power source for the microcomputer Q203 etc.

Figure 5A:
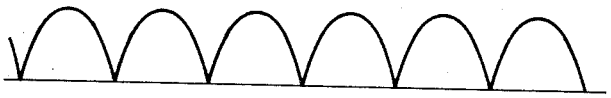
FIG. 5A and FIG. 5B show wave form chart indicating signals in the circuit shown in FIG. 4, wherein (a) indicates a signal on a signal line S1 while (b) indicates that on a signal line S2.
Figure 5B:
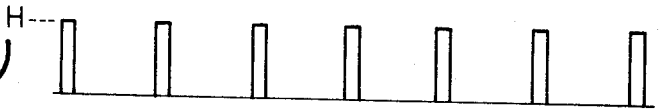

At the start of power supply through a main switch MS, the microcomputer Q203 is reset by an unrepresented port INIT, thus rendered ready for executing the control program according to the flow charts to be explained later. As shown in FIG. 5(*a*), a full-wave rectified signal from diodes D3, D4 is inverted and amplified by an inverter Q215 to provide zero-cross pulses assuming high-level state in the vicinity of zero-crossing points of the wave form of the AC power supply, as shown in FIG. 5(*b*), which are supplied to ports INT and J1. The signals shown in FIGS. 5(*a*) and 5(*b*) respectively correspond signal lines S1, S2 shown in FIG. 4. When the microcomputer Q203 is enabled for interruption, it enters the interruption program at the start of a zero-cross pulse S2 as shown in FIG. 5(*b*) supplied to said port INT. On the other hand the port J1 is utilized for distinguishing the frequency of the power supply (50/60 Hz) by counting the number of zero-cross pulses entered within a determined period by means of an internal program.

Subsequent to the initial resetting of the microcomputer Q203 after the start of power supply, the control unit shown in FIG. 4 initiates the control sequence according to the flow charts to be explained later.

The start of the control sequence by the microcomputer Q203 can be confirmed by the lighting of the power indicator lamp 48*a* and an indication "1" of the segment display unit 46*a*. After said initial resetting, the microcomputer Q203 starts a first timer, and detects the high-level state at the port J1. The program does not proceed to the succeeding step unless the high-level state is detected, and an abnormality is identified if such detection is not achieved until said first timer expires. Simultaneous with the high-level detection at the port J1, a timer for 50/60 Hz detection is started. In the present embodiment said timer has a duration of 100 msec., and, if started at the high-level state as shown in FIG. 6(*a*) and 6(*b*), counts the zero-cross pulses obtained from the AC power supply during a period (a)→(b). Thus, in case the frequency is 50 Hz [FIG. 6(*a*)], the pulse count is ten at maximum during 100 msec. excluding the first high-level pulse. On the other hand in case the frequency is 60 Hz [FIG. 6(*b*)], the pulse count during 100 msec. is eleven at minimum, similarly excluding the first high-level pulse. In this manner the power supply frequency can be identified by classifying a pulse count equal to or less than ten as 50 Hz and a count exceeding ten as 60 Hz, and an exact control can be realized even when the power supply frequency is changed. Also an abnormality signal may be released in response to a count not exceeding six, since such count usually results from a trouble such as a failure at least either one of the diodes D3, D4. FIG.

7(*a*) indicates a signal S12 obtained when either one of said diodes D3, D4 becomes broken, and FIG. 7(*a*) indicates a signal S22 obtained after inversion and amplification of said signal S12 by the inverter Q215. Said signals S12, S22 correspond respectively to those S1, S2 shown in FIG. 4. In addition to the indication of an abnormality to the operator, it is also possible in such case to still enable the copying operation by replenishing defective portions in the control sequence. For this purpose it is necessary to complete the functions of the copier by compensating the abnormalities in the zero-cross pulses with the microcomputer.

As an example, a trouble expected to arise from the failure of the diode D3 or D4 is the timing of turning on the halogen heater H1 which is controlled by the zero-cross pulses, and the duration of the initial waiting mode becomes longer since said timing is reduced approximately a half compared to the normal case. Also the duration of the timers controlled by the zero-cross pulses from the inverter Q215 becomes doubled. In order to rectify these abnormalities the timers counting the zero-cross pulses have to be set to a half count in case the aforementioned pulse count does not exceed six. Also the waiting time may be reduced by starting a timer corresponding to 50/60 Hz from a zero-crossing point and activating the halogen heater H1 when said timer expires at the next zero-crossing point. Such forced timer starting is not effected if the heater is turned off after the fixing roller 10*a* has reached the determined target temperature. Also the halogen heater may be turned on in response to the trailing end of a zero-cross pulse supplied to the port J1, instead of the aforementioned timer.

In case of such compensation, however, certain users may not be able to find abnormalities, since the copying operation is still possible even when either one of the diodes D3 and D4 fails, or when the number of zero-cross pulses becomes abnormal. Also such failure of the diode, if left unmended, will lead to various troubles such as a shortened service life of the copier. Consequently it is also possible to suspend the copying function simultaneously with the detection of the abnormal state. In response to a pulse count zero or one the apparatus releases an abnormality signal since the copier is not longer operable under such pulse count.

Figures 8, 9:
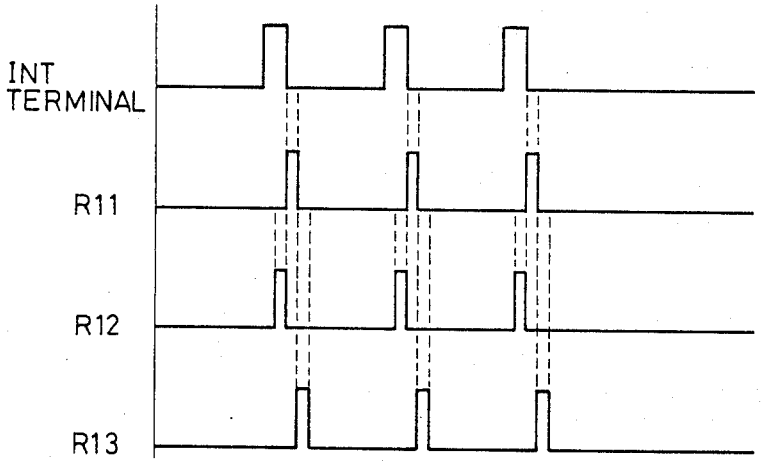
FIG. 8 is a chart showing the relationship between input/output ports of a control unit and sensors or keys shown in FIG. 4.
FIG. 9 is a wave form chart showing an input signal to a port INT and output signals from ports R11, R12, R13 shown in FIG. 4.

Again referring to FIG. 4, the control unit is provided with input ports K1, K2, K4 and K8 which are connected with output ports R11–R13 through various sensors and input keys as shown in FIG. 8. More specifically the input port K1 is connected to the minus key 46*c* and the clear/stop key 46*d;* the input port K2 is connected to the copy key 47*e* and the plus key 46*b;* the input port K4 is connected to the copy discharge sensor Q3, and home position/back position (HP/BP) sensor MS3; and the input port K8 is connected to a jam killer sensor, the sheet feed sensor Q2 and the registering position sensor MS4. Signal entries from said sensors and keys are made at timings shown in FIG. 9. When an interruption program is started at the start of a pulse entered into the port INT, output ports R11, R12, R13 respectively release pulse signals at determined but different timings, and simultaneously the states of the input ports K1–K8 are stored in a random access memory in the computer Q203 to read the input signals. The output port R11 normally releases pulses of a frequency of 100–120 Hz and of a high-level duration of 100–200 μsec as dynamic scanning signals, but, in the presence of an abnormal phenomenon or function or sheet jamming, releases a static signal or oscillating signals of a duration of 0.6 seconds with an interval of 0.6 seconds. The normal oscillating pulses of a duration of 100–200 μsec. from the port R11 are absorbed by an unrepresented condenser connected thereto and are therefore not utilized for lighting the jam indicator lamp.

The control unit Q203 is further provided with output ports R0–R13, R14 and Q0–Q7, which are connected in independently controllable manner as summarized in FIG. 10. As shown in FIG. 10, the output port R0 is usually not used. The output port R1 is connected to the cassette sheet feed solenoid SL301; the output port R2 to the original plate advance solenoid SL2; the output port R3 to the original plate stop solenoid SL1; the output port R4 to the registering shutter SL3; the output port R5 to the power supply indicator lamp 48*a;* the output port R6 to a bias switching circuit B1 enabling image density control by the density control lever 47; the output port R7 to a high-voltage circuit HV; the output port R8 to the main motor M1 for driving the photosensitive drum 3 etc.; the output port R9 to the halogen lamp LA1; the output port R10 to the halogen heater H1; the output port R14 to the manual sheet feed solenoid SL4; and the output port R11 to the jam indicator lamp 48*b*. Also the output ports Q0–Q7 are connected to the segment display unit 46*a*.

Now there will be given an explanation on the temperature control employed in the present embodiment. Since the microcomputer Q203 is provided with an analog-to-digital converting function as explained before, the temperature control of the halogen heater H1 is conducted by entering the analog signal from the temperature control element (thermistor) TH1 into the input port A1 and converting said signal into digital signals, which will hereinafter be called A/D converted values. For achieving effective temperature control for the fixing roller 10*a* from a temperature lower than 50° C. to a temperature as high as 200° C. with said thermistor TH1, a resistor R203 is connected parallel thereto, whereby the resistance of said thermistor TH1 is given a narrower range and is adjusted to a value suitable for conducting the precise and faithful temperature control of the fixing roller 10*a* in the vicinity of 180° C.

Figure 11:
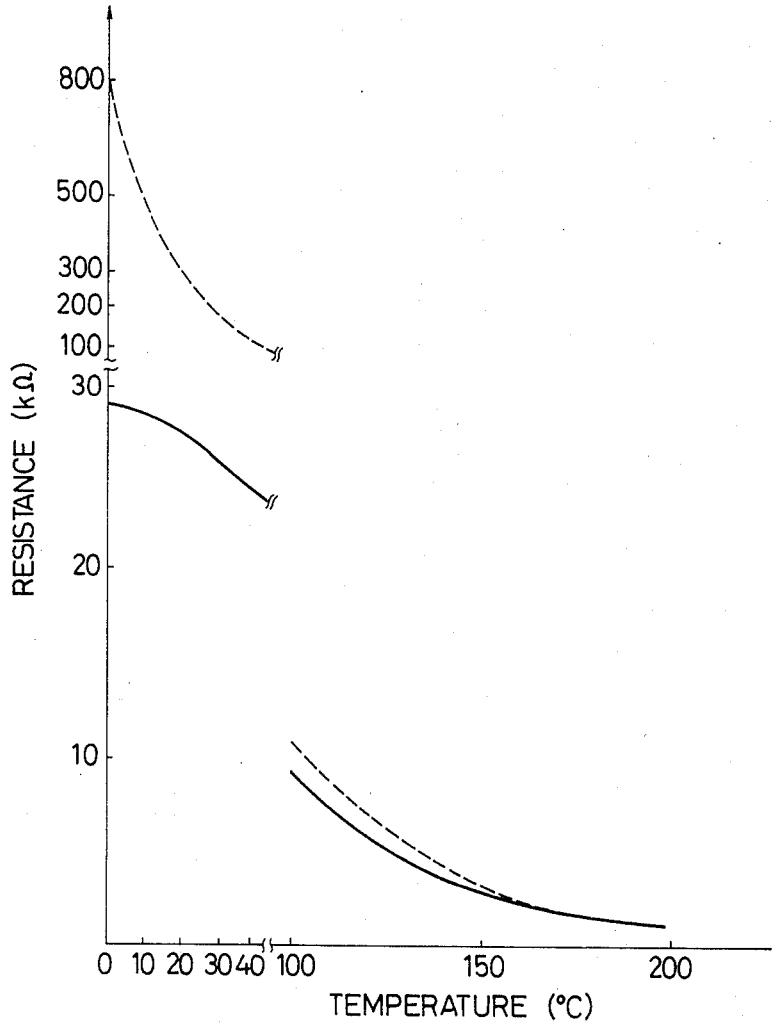
FIG. 11 is a temperature-resistance characteristic chart of a thermistor and of a thermistor connected with a resistor in parallel.

In a thermistor of a resistance range from 0 to 800 kΩ, a resistance change of 1 kΩ corresponds to a temperature difference in excess of 10° C. in the vicinity of 180° C . Also a mere conversion of the resistance range of 800 kΩ with an 8-bit A/D converter corresponds to data in excess of 3 kΩ per bit. Consequently a precision of ±1° C. cannot be achieved around 180° C . However, the parallel connection of the resistor R203 to the thermistor TH1 allows a precise control around the target temperature (180° C.) and still enables detection to a certain extent at a lower temperature, thus realizing optimum temperature control. FIG. 11 compares the temperature-resistance characteristic of the parallel connection of the thermistor TH1 and resistor R203, represented by a solid line, with that of the thermistor TH1 alone, represented by a broken line. As can be seen from this chart, said parallel connection shows a smaller resistance change for a given temperature change, in comparison with the case of the thermistor TH1 alone. Consequently, in the use of an 8-bit A/D converter for dividing the entire resistance range, a more precise temperature control becomes possible because of a smaller resistance range per bit.

FIG. 12 shows the A/D converted values of the resistance of the thermistor TH1 connected parallel to the resistor R203. Also FIG. 13 shows the conversion of the resistance of the thermistor TH1 into temperature.

It will be understood from FIGS. 12 and 13 that the A/D converted value varies in response to even a small temperature change in the vicinity of 180° C. but, at a lower temperature, for example in the vicinity of 20° C., the A/D converted value shows a change only in response to a considerable temperature change.

As explained in the foregoing, the present embodiment is capable of temperature control with an improved precision and over a wider temperature range, by means of a simple circuit structure employing an 8-bit A/D converter. Resistances R206, R207 and R208 are key factors for defining the A/D converted values and determine the voltages at ports $V_{REF}$ and $V_{ASS}$. The A/D converted value corresponding to an input voltage x(V) to the input port A1 is calculated as follows:

$$(V_{ASS}-V_{REF})/255=a$$

$$(x-V_{REF})/a=b$$

The A/D converted value corresponding to said voltage x(V) is obtained by hexadecimal conversion of the above-mentioned value b.

Thus, the circuit of the present embodiment is constructed in such a manner that the A/D converted value becomes equal to "FF" when the thermistor TH1 is cut off, and equal to "00" when said thermistor is short-circuited. The correspondence between the resistance of the thermistor TH1 and the A/D converted value may be modified in various manners by suitable selection of the resistors R206, R207, R208, R201, R203 and R202 according to the state of use, but the present embodiment employs a structure allowing precise temperature reading under secure temperature control.

In the following there will be given examples representing the range of various temperature control modes achievable by suitable selections of the resistors R206, R207, R208, R201, R203 and R202. The control mode to be actually employed should be determined in consideration of the desired function of the apparatus.

(1) Detection of thermistor breakdown: The thermistor breakdown can be detected from the difference in resistance of the thermistor TH1 between the state in actual use and the breakdown state. For this purpose the A/D converted value corresponding to a maximum resistance of the thermistor TH1 as shown in FIG. 4 in actual use can be selected as "F0" while that corresponding to the thermistor breakdown can be selected as "FF". Also the thermistor breakdown can be satisfactorily identified if an A/D converted value exceeding "FA" is classified as "breakdown", even in the presence of various external perturbations. Consequently an instantaneous detection of thermistor breakdown is rendered possible if an A/D converted value exceeding "FA" is classified as breakdown.

In case the A/D converted value corresponding to the maximum resistance, for example 800 kΩ, of the thermistor TH1 in actual use has to be selected as "F8" in consideration of design parameters, the A/D converted value corresponding to the thermistor breakdown may be selected, for example, as "FE" to "FF".

The conventional method for thermistor breakdown detection, in which the breakdown is identified in case the thermistor does not show a change in the resistance within a determined period after the start of power supply, has been associated with a drawback that the heater is unnecessarily heated if the power supply is manually turned on and off repeatedly before the lapse of said determined period. Said drawback can however be avoided by the instantaneous breakdown detection explained above.

In further consideration of a failure resulting from a mechanical trouble, such as an incomplete contact of a connector, it is also possible to measure the resistance of the thermistor or the corresponding A/D converted value over a determined period, without activating the heater. In such case the thermistor breakdown is identified if the A/D converted value remains at a same value, for example exceeding "FA", over said determined period.

As an alternative method, the breakdown may be identified by activating the heater for a determined period, and if the A/D converted value does not change during said determined period. In such case, however, the A/D converted value to be detected should be selected close to the A/D converted value corresponding to the breakdown state in order to avoid excessive heating of the heater by the repeated on-off operations of the power supply. In case the breakdown of the thermistor TH1 is detected, the halogen heater may be turned off or the copier may be shifted to the waiting mode, or such failure may be signalled to the operator.

The foregoing breakdown detecting methods are also applicable to other temperature control elements such as a posistor.

(2) Detection of abnormally high temperature: The halogen heater H1 may be continuously energized to abnormally elevate the temperature of the fixing roller 10*a*, for example by a failure in a triac included in the driving circuit for said halogen heater. However such abnormally high temperature can be easily monitored by the thermistor TH1 through a suitable combination of the resistance thereof and the A/D converted value, and the result of such monitoring may be utilized for example for activating a safety device such as for interrupting the AC power supply. Also in response to the detection of such an abnormally high temperature, the copier may be shifted to a waiting mode in which the heater is turned off.

The above-explained functions are easily achievable by suitable modifications in the combination between the resistance of the thermistor TH1 and the A/D converted value.

Additional abnormality detections are rendered possible also by the above-described structure in which the analog signal from the thermistor TH1 is supplied to the input port A1 of the microcomputer Q203 for digital conversion therein. As an example, a rapid change in the input signal from the thermistor may be utilized for detecting a thermistor breakdown or a sheet jamming between the fixing roller 10*a* and the thermistor TH1. Also said circuit structure may be utilized for detecting, for example, an abnormal temperature curve as a function of the energizing time of the halogen heater H1, a rapid temperature rise resulting from a failure in an unrepresented driving circuit for the halogen heater during an unenergized period of said heater, a temperature lowering resulting from a failure in said driving circuit during an energized period thereof, an abnormal ripple in the temperature control etc. The precision of the above-explained functions can be further improved by suitable combinations of the resistors R206, R207, R208, R201, R203 and R202 as already explained before.

Now there will be given a further detailed explanation on the temperature control for the fixing roller 10a. In the present embodiment, as already explained in the foregoing, the fixing roller temperature is obtained by reading the surface temperature of said roller with a thermistor TH1 and converting thus read value into the A/D converted value, and the halogen heater H1 is subjected to zero-cross control by means of the zero-cross pulses explained before.

Figure 15:
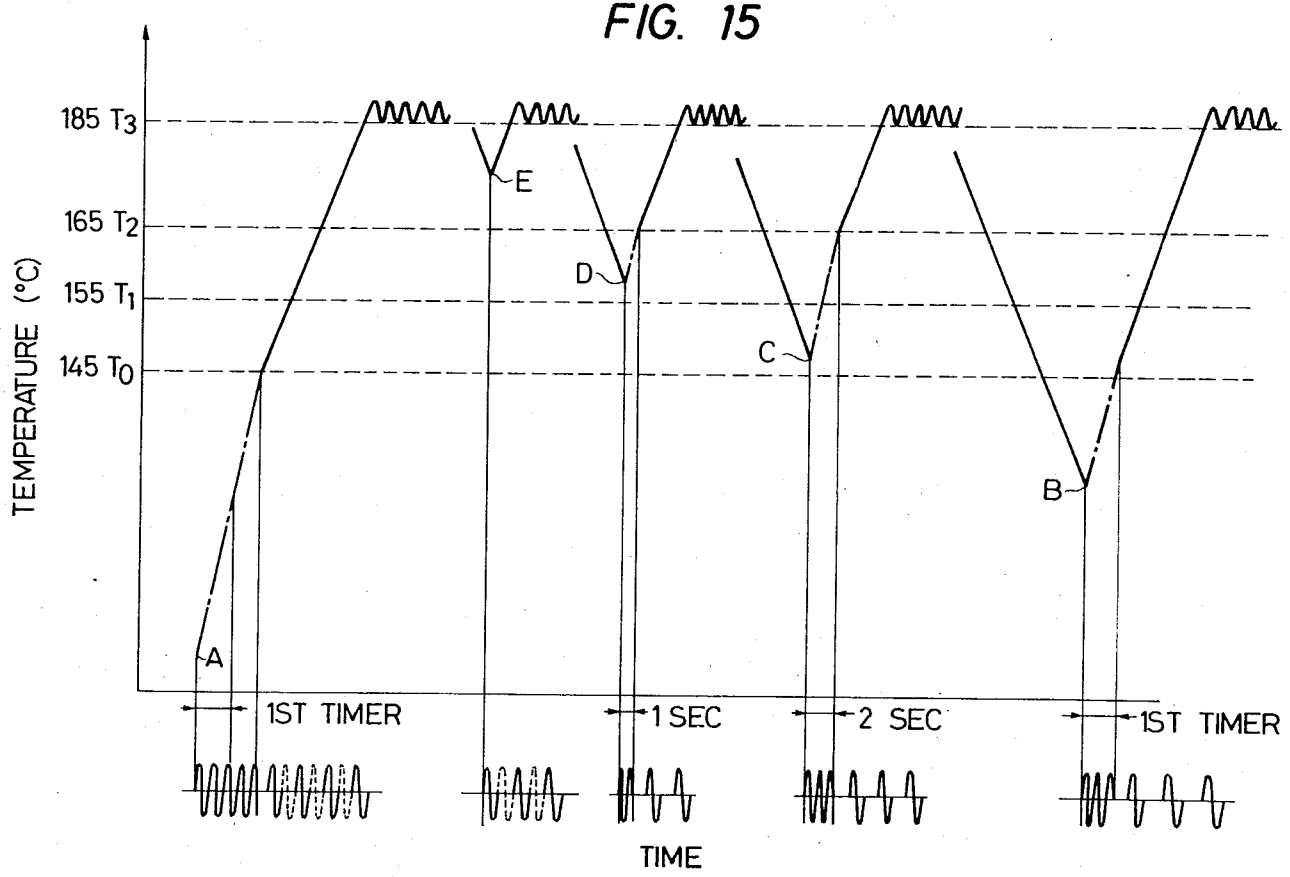
FIG. 15 is a chart showing the temperature control procedure in the present embodiment.

As shown in FIG. 15, the temperature control in the present embodiment is achieved in the following manner, taking T0(145° C.), T1(155° C.), T2(165° C.) and T3(185° C.) as reference temperatures. In FIG. 15, a chain line indicates the behavior of the surface temperature of the fixing roller 10a in full-wave energization, and a solid line indicates the behavior of the surface temperature when the heater is turned on for a cycle and then off for a cycle.

(i) In case the surface temperature of the fixing roller 10a detected by the thermistor TH1 at the start of power supply is lower than the determined temperature T0 as shown by A or B in FIG. 15, a first timer is started and the halogen heater is full-wave energized. A detection whether the temperature exceeds T0 is conducted when the first timer expires, and, if not as shown by A in FIG. 15, full-wave energization of the heater is continued until the temperature T0 is detected. At said detection of the temperature T0, the waiting mode is terminated to enable the copying operation. Also after said detection, the energization of the halogen heater H1 is made intermittent, on for a cycle and off for a cycle. On the other hand, if a temperature exceeding T0 is detected at the expiration of the first timer as shown by B in FIG. 15, the waiting mode is terminated and the energization is changed to intermittent basis, on for a cycle and off for a cycle as explained above. The power supply indicator lamp 48a flickers during the waiting mode. In order to maintain a constant flickering frequency regardless of the power supply frequency, the number of zero-cross pulses to be counted is modified according to the identification whether the power supply frequency is 50 Hz or 60 Hz. The power supply indicator lamp 48a is continuously lighted when the waiting mode is terminated.

(ii) In case the temperature detected by the thermistor TH1 at the start of power supply is located between T0 (145° C.) and T1 (155° C.) as shown by C in FIG. 15, the waiting mode is terminated after a full-wave energization for 2 seconds, and the energization is thereafter changed to intermittent basis, on for a cycle and off for a cycle.

(iii) In case the temperature detected by the thermistor TH1 at the start of power supply is located between T1 (155° C.) and T2 (165° C.) as shown by D in FIG. 15, the waiting mode is terminated after a full-wave energization for 1 second, and the energization is thereafter changed to intermittent basis, on for a cycle and off for a cycle.

(iv) In case the temperature at the start of power supply is located between T2 (165° C.) and T3 (185° C.) as shown by E in FIG. 15, the waiting mode is terminated and the energization of the halogen heater is changed to intermittent basis, on for a cycle and off for a cycle. The temperature is finally stabilized toward T3 (185° C.), and, after the surface temperature of the fixing roller 10a reaches T3, said surface temperature is stabilized in the vicinity of T3 by repeating the intermittent energization of the halogen heater H1.

In the aforementioned case (i) in which the surface temperature of the fixing roller 10a is lower than T0, the first timer is started and a detection whether the temperature exceeds T0 is conducted when the first timer expires. In a second embodiment, if the temperature is detected as still lower than T0, the full-wave energization is effected for the duration of a second timer, which is repeatedly activated until the temperature exceeds T0. The waiting mode is terminated when the temperature exceeds T0 in the same manner as explained before.

Also in said case (i) in which a detection whether the temperature exceeds T0 is conducted when the first timer expires, a third embodiment consists, if the detected temperature is still lower than T0, of effecting the full-wave energization until the temperature T0 is detected. Simultaneous with the detection of said temperature T0, the energization is changed to intermittent basis, on for a cycle and off for a cycle, and the second timer is started. The waiting mode is terminated when said second timer expires. It is also possible to start a third timer combined with fullwave energization when the temperature T0 is reached, and to terminate the waiting mode when the third timer expires.

Furthermore, in said case (i) in which a detection whether the temperature exceeds T0 is conducted when the first timer expires, a fourth embodiment consists of, if the detected temperature is still lower than T0, of continuing the full-wave energization by repeatedly starting the first timer until the temperature T0 is reached. The energization is changed to intermittent basis, on for a cycle and off for a cycle and the second timer is started when said temperature T0 is reached, and the waiting mode is terminated at the expiration of said second timer.

The use of timers in the present embodiment for temperature control of the fixing roller 10a allows to simplify the complicated temperature control program. Also the combination of the switching of energizing method for the halogen heater H1 with the use of timers not only allows to prevent the overshooting phenomenon but also enables precise temperature control.

As a safety mechanism in the present embodiment, the energization of the halogen heater H1 is suspended in the following cases, which are regarded as abnormalities in the driving circuits including the halogen heater H1 or the thermistor TH1:

(i) When the temperature of the fixing roller 10a does not reach a first determined temperature within 11 seconds after the start of power supply;

(ii) when the temperature of the fixing roller 10a does not reach a second determined temperature, for example 145° C., within 30 seconds after passing the first determined temperature, for example 70° C.; and (iii) when the halogen heater is continuously energized for 20 seconds after the copying operation is enabled.

For this purpose the temperature of the fixing roller 10a is detected by the thermistor, and the duration of the timer for identifying the abnormal state is varied according to the detected temperature or to particular timings. The duration of said timer may also be varied according to the operation status of the copier.

As explained in the foregoing, the present embodiment ensures increased safety as it enables the detection of abnormalities in the driving circuits including the thermistor and the halogen heater, which could not be detected in the conventional method.

The structure of the present embodiment allows the use of a high-power halogen heater, thus enabling to reduce the waiting time for the benefit of the users.

Also the safety mechanism of the present embodiment is particularly effective when a high-power halogen heater is employed.

Now there will be given an explanation on the function of the microcomputer Q203, while making reference to the flow charts shown in FIGS. 16(*a*) to 16(*h*).

In a copier embodying the present invention, in response to the turning on of the main switch MS, a reset signal, composed of a pulse of a duration of about 10 msec., is supplied to the reset port of the microcomputer constituting the control unit, and there is initiated a control flow to be explained in the following.

Figures 1, 2, 17:
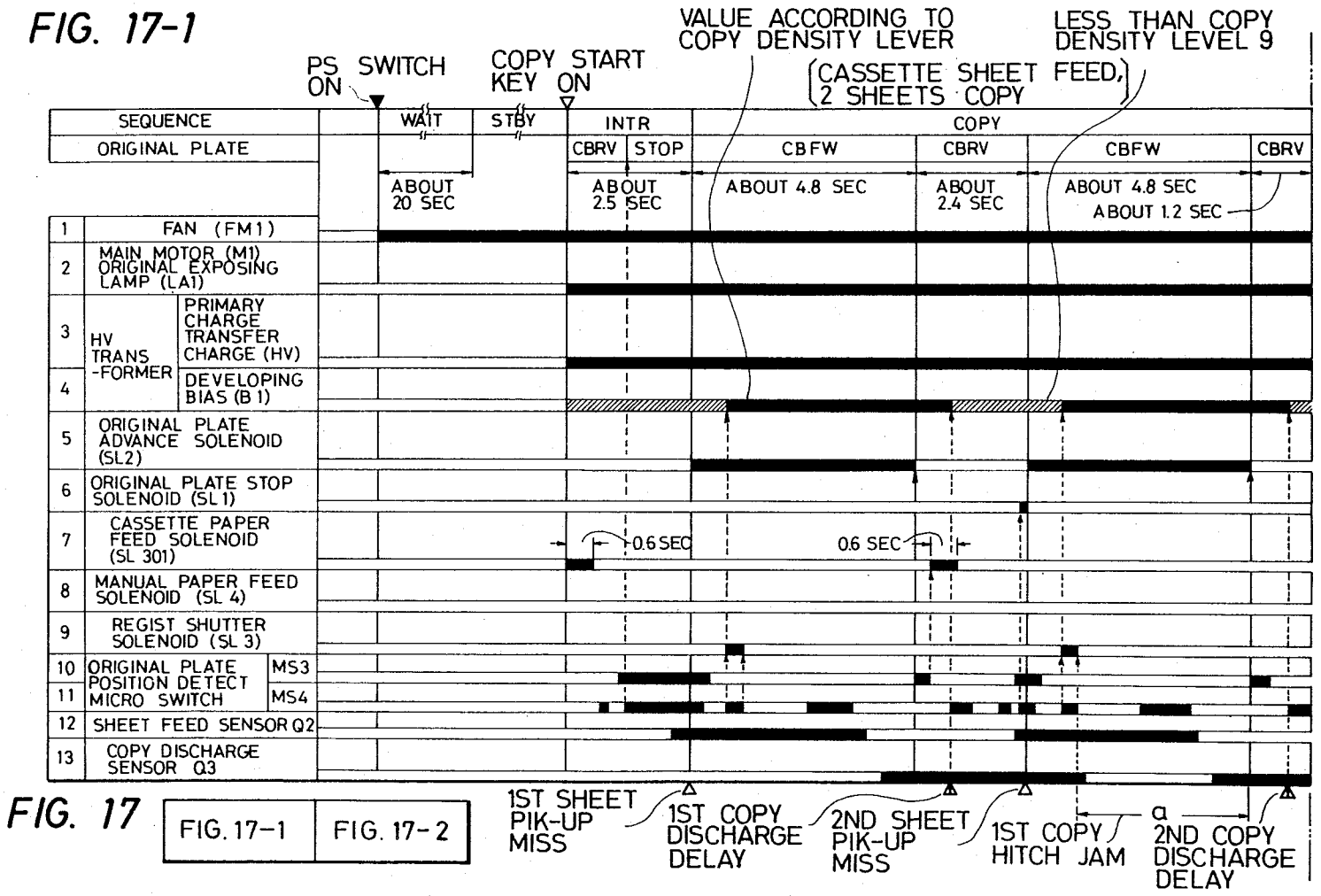
Figures 2, 17:
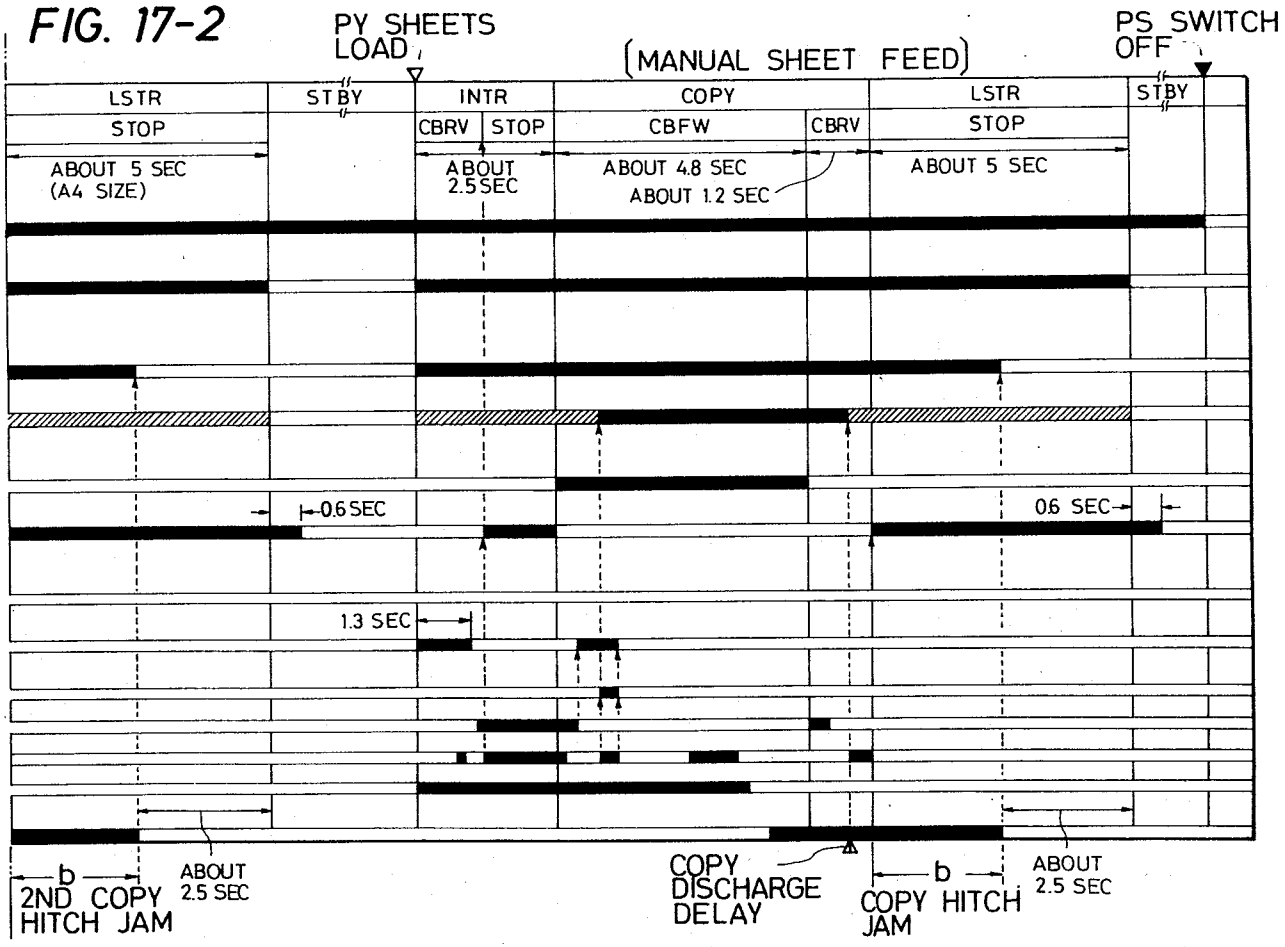

Following Tabs. 1 and 2 summarize the flags employed in said flow charts and their functions, and FIG. 17 summarizes the function timings of various components of the copier. In FIG. 17, Δ indicates a check procedure for sheet jamming caused by a sheet feeding error; ⚠ indicates a check procedure for sheet delay jam at the discharge exit; |⟷| indicates a check procedure for sheet stay jam at the discharge exit; case (a) is identified as a jam if a sheet continues to be present during the indicated period; and case (b) is identified as a jam if a sheet is not discharged within 4.5 seconds. Also in FIG. 17, a black area indicates the duration of a driving current or the duration of detection with a sensor, and a hatched area in the developing bias indicates a period in which the image density control by the density control lever 47 is disabled.

Furthermore, in FIG. 17, "WAIT" represents a state before the fixing roller reaches the determined temperature; "STBY" a copying enabled state; "INTR" a pre-rotation state of the photosensitive drum; "CBRV" a period of reverse motion of the original document plate; "STOP" a period in which the original document plate is stopped; "CBFW" a period of forward motion of the original document plate; and "LSTR" a post-rotation state of the photosensitive drum after the original document plate is stopped.

TABLE 1

| FLAG | Function |
|---|---|
| F/REGIST | Set when the registering switch is turned on, and reset at the reverse motion of the original document plate. |
| F/REG.1 | Set when the registering switch is turned off after F/REGIST is set, and reset at the reverse motion of the original document plate. |
| F/OUTLET | Used for checking the stay jam of sheet. Set after the delay jam check is cleared, and reset when the discharge sensor is turned off. |
| F/OUTLET ① | Used for checking the delay jam of sheet. Set when the discharge sensor is turned on while F/OUTLET is reset. |
| F/STOP | In sheet feeding from cassette, set in response to a display "0" and reset at the end of post-rotation step. In manual sheet feeding, set when the sheet entrance sensor is turned on, and reset when it is turned off. |
| F/INITIAL 2 SEC. | Used for timer counting when the temperature is lower than T0. Set when the timer expires. |
| F/LAMP ON | Set in response to a display "P" or when the power supply indicator lamp is turned on, and reset when it is turned off. |

TABLE 1-continued

| FLAG | Function |
|---|---|
| F/WAIT TIMER | Set when the timer for controlling said indicator lamp is activated. |
| F/PLUS | Set when the plus key is turned on, and reset when it is turned off. |
| F/MINUS | Set when the minus key is turned on, and reset when it is turned off. |
| F/UPPER DIGIT ① | Set when the upper digit of the segment display unit is turned on, i.e. when a number equal to or larger than 10 is displayed. |
| F/SEPL | Reset when the timer for the manual sheet feed solenoid is started, and set when said timer expires. |

TABLE 2

| FLAG | Function |
|---|---|
| F/PL ON | Set when the timer for cassette sheet feeding solenoid is started, and reset when said timer expires. |
| F/HEATER OFF | Set when the halogen heater is turned off, and reset when it is on. |
| F/FREQUENCY | Set when the 50/60 Hz check program is executed in an interruption step. |
| F/ZERO DETECT | In 50/60 Hz check program, set when the zero-cross signal assumes at port J1 assumes high-level, and reset when it assumes low-level. |
| F/DISCON | Set when the thermistor is identified as not broken. Breakdown is identified if this flag is not set within 11 seconds after the start of power supply. |
| F/145 | Set when the temperature detected by the thermistor exceeds 145° C. |
| F/155 | Set when the waiting mode is terminated. |
| F/JAM | Set at the abnormality detection and at sheet jamming. |
| F/COPY | Set in response to a copy instruction, and reset at the end of copying operation. |
| F/NO SHEET | Set when the absence of sheet is detected, and reset by the actuation of the plus key, minus key, clear key or copy key during the standby mode. |
| F/NO KEYING | Set only during the copying operation, including pre-rotation step. |
| F/SHEET COPY | Set at the manual feed copying, and reset at the end of said copying. |
| F/CASSETTE (F/CASSETTE START) | Set at the sheet feeding from cassette, and reset when the image scanning is enabled or in the absence of sheet. |
| F/AUTO | Reset at the timer start at post-rotation, pre-rotation or abnormality detection by the thermistor, and set when the timer expires. |
| F/OPT OUT | Reset at an abnormality in the original plate. |
| F/PL OFF | Used for starting the timer for checking abnormality in the original plate. |

After the initial resetting, the microcomputer clears the random access memory (RAM), automatically sets "1" as the copy number and accordingly displays "1" on the indicator unit (Step 100).

Then an internal timer is set in order to identify the power supply frequency (50 or 60 Hz) from the zero-cross signals supplied to the port J1 (step 101), and a permission for interruption is set in order to enable internal interruption at the expiration of said timer (step 102). Said timer is started when the zero-cross signal at the port J1 assumes the high-level state (step 103), and the program remains in the loop of said step 103 if said high-level state is not obtained. Though not shown in the flow chart, it is also possible to identify an abnormality by detecting a stay in said loop over a determined period. In response to a high-level state of the zero-cross signal, the program proceeds to a step 104 for starting said internal timer of a duration of 100 msec. and setting an internal memory flag F/ZERO DETECT, which is set at the high-level state of the port INT or J1. A flag F/FREQUENCY shown in a step 105, which is set in response to an internal interruption after the expiration of 100 msec. of said timer, is not set in this state because of the absence of interruption. In the subsequent steps 106–110, the content of the memory is stepwise increased in response to each high-level state at the port INT.

9 or 11 zero-cross signals are normally counted during said period of 100 msec. respectively corresponding to a power supply frequency of 50 or 60 Hz. An interruption program shown in FIG. 16(*f*) is started at the start of a first zero-cross signal after the expiration of said internal timer to identify if the flag F/FREQUENCY is set (step 301), and, if not, a step 402 is executed to set said flag. Then a step 403 forbids the internal interruption, and steps 404 and 405 identifies whether the count of the memory is at least equal to "10", thus identifying whether the power supply frequency is 50 Hz or 60 Hz. If the count is smaller than 10, a frequency of 50 Hz is identified and the program returns to the main flow after setting a flag F/50 Hz in a step 406. If otherwise, the program returns immediately to the main flow.

Subsequent steps 113, 114 set the initial state of the apparatus, such as lighting of the power supply indicator lamp, switching of the developing bias etc. Then a step 115 sets a timer for reading a stable value which is detected by the thermistor THl and supplied to the port A1.

In the present embodiment, the signal from the thermistor TH1 is used for controlling the halogen heater H1 after A/D conversion. Thus, a step 116 reads the signal from the thermistor TH1, and a step 120, 121, 122 or 123 is executed according to the value of said reading. If a step 117 detects that the temperature is lower than 145° C., the program proceeds to the step 120 for setting a 2-second timer for determining the minimum full-wave energization time of the halogen heater H1. If a step 118 identifies that the detected temperature is between 145° C. and 155° C., the program proceeds to the step 121 for setting a flag F/145 indicating a temperature higher than 145° C., a flag F/DISCON. indicating the absence of thermistor breakdown, and a 2-second timer for defining the minimum full-wave energization time of the halogen heater. If a step 119 identifies that the detected temperature is between 155° C. and 165° C., the program proceeds to the step 123 for setting the flag F/145, the flag F/DISCON. and a 1-second timer for defining the minimum full-wave energization time. If the detected temperature is higher than 165° C., the program proceeds from the step 119 to the step 122 for setting the flag F/145, the flag F/DISCON. and a flag F/155 indicating the termination of the waiting mode, and setting a 20-second timer for defining the maximum continuous energization time. In case the heater is thereafter continuously energized for 20 seconds, the 20-second timer expires in the interruption program and F/AUTO is set (step 311), and steps 315, 316 identify an abnormality in the temperature control. In such state the indicator 46*a* displays "E" and "□" alternately and the jam indicator lamp 48*b* is lighted to indicate the presence of an abnormality in the driving circuit including the thermister.

Then the input signal from the sheet discharge sensor Q3 is inspected, and, if a sheet is detected, the program proceeds from the step 124 to a flow 7B shown in FIG. 16(*e*), thus lighting the jam indicator lamp. Said flow turns off the main motor (step 240), then sets the jam flag F/JAM (step 240-1), turns of the high-voltage circuit HV (step 240-2) and turns on the jam indicator lamp 48*b* (step 240-3). In order to cause the flickering of said indicator lamp at an interval of 0.6 seconds, a loop is repeated to turn off the indicator lamp after sensing the lapse of 0.6 seconds (step 240-4) and to thereafter turn on the indicator lamp again (step 240-3) after the lapse of 0.6 seconds.

After the check procedure explained above is completed, a step 125 starts the control of the apparatus in response to each zero-cross pulse received at the port INT. Said apparatus is provided with a function of detecting service life for example of the photosensitive drum, and a detecting step (step 126) is conducted after the completion of copying operation of a determined number. Upon detection of the expiration of the service life, the program proceeds to a step 129 for flickering an indication "1" at an interval of 0.5 seconds on the segment display unit 46*a*. More specifically data "1" are stored in a RAM1 for storing display data (step 129-1) and displayed for 0.5 seconds (steps 129-2 and 129-3), then blank data for blank display are stored in said RAM① and displayed for 0.5 seconds (steps 129-4 and 129-5), and these steps are thereafter repeated.

In the absence of detection of the expiration of the service life, the program proceeds to a step 127 for executing the normal sequence control for identifying whether the copy key is actuated, and, if so, controlling the driving system etc., while the control of temperature and indicators is achieved by interruption programs to be initiated at the start of the zero-cross signal.

At first there will be given an explanation on the main sequence control flow. In response to the actuation of the copy switch 47*e*, the copy flag F/COPY is set, whereby the program proceeds from a step 127 to a step 128 for identifying whether the jam killer switch, for disabling the jam detection, is closed. Thereafter the program proceeds to a step 130 to turn on the main motor M1, deactivate the original plate stop solenoid SL1 (said original plate performs reverse motion if said solenoid is turned off when the main motor is turned on), stop the flickering, if any, of "P" indicating the absence of recording sheets, and turn on the exposure lamp A1 and the high-voltage circuit HV. Then the program proceeds to a step 131 in FIG. 16(*b*) for identifying, by the state of the manual sheet feed flag F/SHEET COPY, whether the manual sheet feed mode is instructed. Said flag F/SHEET COPY is set, in the manual sheet feed mode, in a step 363A in an interruption program shown in FIG. 16(*h*). In case of the cassette feed mode, a step 132 is executed to energize the cassette sheet feed solenoid SL301 and start a timer, which, upon expiration, deactivate said solenoid SL301. Said deactivation and the function of said timer are conducted by a step 380 in the interruption flow. More specifically, a step 380-1 stepwise reduces the count at each zero-cross pulse, and, upon expiration, a step 380-2 resets the flag F/PLON1 and deactivates the cassette sheet feed solenoid SL301. On the other hand, the manual sheet feeding is handled in steps 361–367 of an interruption flow shown in FIG. 16(*h*) for a stand-by mode prior to the actuation of the copy switch. When the sheet feed sensor Q2 is activated in a step 363, a step 363A is executed to set the aforementioned flag F/SHEET COPY, reset the flag F/SEPL for energizing the manual sheet feed solenoid SL4 and set the manual sheet feed timer, then a step 376A effects the timer counting, and, when the timer expires in a step 376A-1, a step 376A-2 executes a flow for activating the manual sheet feed solenoid SL4.

Subsequently a step 134 sets the timer for the pre-rotation step. Since the flag F/50 Hz previously determined in the steps 405, 406 indicates the result of identification of frequency, the number of clock pulses to be counted by the timer is set to n1 or n2 respectively for 50 Hz or 60 Hz according to said result, whereby the timers counting the zero-cross pulses can be set to a substantially constant time regardless of the power supply frequency. Then a step 135 sets the original plate abnormality detecting timer to a value longer than the time required by the original plate to return to the start position from the reversing position, for example from a position (g) to (b) in FIG. 14. An abnormality in the reversing motion of the original plate is detected in case the original plate does not reach the start position when the timer expires. Unless particularly written as an internal timer, all the timers employed functions by counting the zero-cross pulses. The aforementioned two timers function simultaneously, and the start position of the original plate is identified by two sensors MS3, MS4 in steps 138, 139, when at first the HP/BP sensor MS3 is activated and then the registering position sensor MS4 is activated, whereupon a step 140 energizes the original plate stop solenoid SL1 to stop the original plate. A step 141 inspects whether the pre-rotation timer has expired, and, if not, the program proceeds to a step 138 to repeat the above-mentioned procedure. A step 137 identifies an abnormality in the original plate from the state of the flag F/OPT OUT in case the detections by the sensors MS3, MS4 are not obtained in the steps 138, 139. Stated differently, the step 137 is utilized for detecting an abnormality in the original plate in case it does not reach the start position. Said flag F/OPT OUT is reset in a step 381, when the timer started by a step 135 expires.

The program then proceeds to a step 142 when the proper detections are obtained in the steps 138, 139 after the completion of the pre-rotation step. The step 142 identifies whether the manual sheet feed mode is instructed, and, if so, the forward motion of the original plate is commenced from steps 159, 160 as will be explained later.

In case the manual sheet feed mode is not instructed, a step 143 resets the flag F/CASSETTE and a step 144 identifies the presence of recording sheet by the sheet feed sensor Q2. If a sheet is detected by said sensor the program proceeds to a step 159, while if the sheet has not been detected, the aforementioned timer for detecting the abnormality in the original plate is changed to a timer for detecting the delay jam, and sheet detection is postponed until the expiration of said timer. If the sheet is sensed within the duration of said timer, the program proceeds to the step 159. If not, a step 146 identifies the absence of sheet and sets the flag F/NO SHEET, whereby a flow 6B is started to terminate the function of the apparatus after the post-rotation step. In the meantime steps 328, 331 of an interruption flow are executed to display flickering "□" on the display unit for indicating the absence of the recording sheet. In case the recording sheet is detected, the step 159 deactivates the original plate stop solenoid SL1, and a step 160 energizes the original plate forward solenoid SL2 and sets a timer of a duration longer than the time required by the original plate to reach the reversing position from the start position, for example from a position c to f in FIG. 14 (6.3–7.5 seconds) for detecting an abnormality in the original plate. Then steps 161 and 162 inspect the abnormality in the original plate, and, if any, a flow 5E is activated to turn off various loads, alternately display "E" and "2" for periods respectively determined in steps 164-1 and 164-2 and light the jam indicator lamp in an interruption flow.

Then a step 166 identifies that the HP/BP sensor MS3 is turned off, and, in case a step 167 identifies the manual sheet feed mode, a step 168 energizes the manual sheet feed solenoid. When the registering position sensor MS4 is activated in a step 169, the identification for the manual sheet feed mode is conducted again, and, the registering shutter solenoid SL3 is energized immediately or after a delay of 10 msec respectively in the manual sheet feed mode or not (step 170), in order to compensate a slight difference in the sheet registration resulting from a difference in the sheet feeding paths to the registering shutter 7. Then a step 171 turns on the bias switching circuit B1, thereby switching the developing bias voltage to a value for image formation.

Said developing bias voltage corresponds to that represented by black area in FIG. 17, in which the image density control by the density control lever 47 is enabled.

Then a step 174 identifies whether the registering position sensor MS4 has been turned off, and if so, a step 175 is executed to deactivate the registering shutter solenoid SL3, deactivate the manual sheet feed solenoid SL4 (only in the manual sheet feed mode) and set the flag F/REG.1. Then a step 176 inspects the detection by the sheet discharge sensor Q3. Delay and stay jams are checked from this point until the HP/BP sensor MS3 is activated in a step 176-1, and a delay jam is thereafter checked until the registering position sensor MS4 is activated in a step 191. The flag F/OUTLET is set in a step 203 or 204 in the absence of a delay jam in a step 176 and in a continuous copying operation. However, since said flag is not set in the first copying operation, the program proceeds to a step 176A, which detects the absence of delay jam in response to the activation of the discharge sensor Q3, thus setting the flag F/OUTLET①. In case the flag F/OUTLET is set, the program proceeds to a step 176B, and the absence of stay jam is identified by the resetting of the flag F/OUTLET only when the discharge sensor Q3 is identified as being turned off. The reversing position of the original plate is identified in a step 176-1 by the activation of the start position sensor, whereby the original plate forward solenoid SL2 is deactivated to initiate the reverse motion. On the other hand, if the flag F/OUTLET is found to be set in a step 178, a stay jam is identified whereby a program 7B is activated to terminate the functions of the apparatus. In the absence of sheet jamming at the reversing of the moving direction, and if the flag F/OUTLET is found reset in a step 178, the program proceeds to a step 179 to identify that the flag F/SHEET COPY is reset, and, if so a step 180 stepwise reduces the content on the display unit, and if said content reaches "□", a step 181 sets the flag F/STOP and executes a stop sequence. A step 183 sets a timer for detecting an abnormality in the reverse motion, in the same manner as already explained in relation to the step 135. In case the flag F/STOP is not set, and in the cassette sheet feed mode, the cassette sheet feed solenoid 301 is energized (step 186).

Subsequently a step 189 check the presence of a delay jam until the registering switch MS4 is activated (position h in FIG. 14) (step 191). The SUBJAM subroutine in step 189 is same as in the step 176 shown in FIG. 16(*b*). In case the absence of delay jam is already detected by the discharge sensor Q3 in the step 176, the jam signal is not generated even if said sensor Q3 is turned off, since the flag F/OUTLET ① is already set. In case the registering switch is turned on in a step 191, a step 192 turns off the bias switching circuit B1 to shift the developing bias to a non-recording state. A step 195 performs a check for the aforementioned delay jam, and, in the absence of such jam, a step 196 resets the flag F/OUTLET ①. Then a step 198 identifies that the registering switch is turned off. In case a step 201 identifies that the flag F/STOP has not been set, the program returns to the beginning from 4B or 5B and repeats the above-explained procedure. On the other hand, in case the flag F/STOP is already set, a step 205 suspends the motion of the original plate and initiates the post-rotation step. Then a step 206 resets the flag F/NO KEYING to enable the key entry, then a step 207-1 sets a timer for detecting sheet stay jamming at the discharge exit, and a step 209 returns the display to the initial copy number, in case of the cassette sheet feed mode. Thereafter, in response to the discharge of a recording sheet from the discharge slot in a step 214, a step 221 turns off the high-voltage circuit HV, and a blank rotation step is conducted in steps 222–224. After the completion of the post-rotation step, a step 229-3 is executed to stop the main motor, turn off the halogen lamp in a step 230, and turns off the original plate stop solenoid SL1 after the lapse of 0.2 seconds (step 231), whereby the stand-by mode is initiated.

The interruption flow is started, during the execution of the main flow and in the absence of detection of an abnormality, at the start of a zero-cross pulse supplied to the port INT. As explained before, steps 402–406 constitute a flow for detecting the power supply frequency by an interruption program with an internal timer.

At first a step 302 inspects whether the flag F/145 has been set, and, if not, the program proceeds to a step 303 to turn on the halogen heater H1. Then a step 304 checks the flag F/INITIAL 2 SECONDS, and, if not set, the program proceeds to a step 342 for executing the count down of the timer set in a step 120 or 121. Subsequently a step 343 checks the flag F/AUTO in order to identify whether the timer has expired. When said timer has expired, the program proceeds to a step 344 to check the flag F/145 to be set when the temperature detected by the thermistor exceeds 145° C. If it is set, the program proceeds to a flow 1-B while if it is not set, a step 345 is executed to set the flag F/INITIAL 2 SECONDS. Then a step 346 resets the flag F/AUTO to be reset at the start of the timer, and the program proceeds to a flow 1-C after activating the breakdown detecting timer (9 seconds) in a step 347. Subsequently a step 305 checks whether the current temperature exceeds 145° C., and, if yes, the program proceeds to a step 306 to set the flags F/145 and F/155 and to terminate the waiting mode. The power supply to the halogen heater H1 after the setting of the flag F/160 is controlled by a flow SUBHC in a step 361 during the standby state, and by a flow SUBHC in a step 369 during a copying operation. In said flow the power supply is intermittent, on for a cycle and off for a cycle, when the temperature is higher than 185° C., and the halogen heater H1 is turned off when the temperature is higher than 185° C.

Then a step 307 sets a timer (20 seconds) for detecting an abnormality in the power supply after the termination of the waiting mode, and a step 308 resets the flag F/AUTO. Then a step 309 sets the flag F/DISCON., then the program proceeds to a step 310 for checking the flag F/HEATER OFF to be set when the halogen heater H1 is turned off, and, if not set, a step 311 executes the count down of the timer. Then the program returns to the step 305, and if the current temperature is still lower than 145° C., the program proceeds to a step 312 for checking the flag F/DISCON. If said flag is not set, the program proceeds to a step 313 for checking whether the current temperature exceeds 70° C., and, if yes, the program proceeds to a step 314 for setting a timer (30 seconds) for detecting an abnormality in the power supply, and a step 309 sets the flag F/DISCON. Said timer executes the count down in the step 111. On the other hand, in case the current temperature does not exceed 70° C. in the step 313, a step 313A executes the count down of the timer set in the step 347, then a step 315 checks whether the flag F/AUTO has been set, and, if said flag has been set indicating that the breakdown detecting timer of the step 347 has worked for 9 seconds, or 11 seconds after the start of power supply, a step 316 generates an abnormality signal by alternating "E" and "□".

Then the program returns to the step 302, and, if the flag F/145 has been set, the program proceeds to a step 340 for checking if the flag F/155 is set. If said flag is set the program proceeds to a flow 3-A, while if it is not set, a step 341 turns on the halogen heater and a step 342 executes the count down of the timer (1 or 2 seconds) set in the main flow.

The program proceeds to a step 317 if the step 310 identifies that the flag F/HEATER OFF is set, and the step 317 to the flow 2-A cause the flickering of the waiting (power supply indicator) lamp during the waiting mode, or of the display "P" in case of the absence of the recording sheet. It is to be noted that the waiting mode and the absence of sheet are not indicated simultaneously. More detailedly, the step 317 checks whether the flag F/NO SHEET to be set in the absence of recording sheet has been set, and, if not, a step 318 checks whether the waiting mode has been terminated. If the waiting mode has been terminated, the program proceeds to the flow 2-A. On the other hand, if the waiting mode still continues, a step 319 checks whether the flag for controlling the timer (0.6 seconds) for indicator control, and, if not, a step 320 sets the flag F/WAIT TIMER, sets a timer and stepwise reduces the set value in response to each zero-cross signal. After the lapse of the determined time, the program proceeds, according to the result of discrimination in a step 324, to a step 325 or 326 thereby intermittently lighting "P" on the segment display unit or intermittently lighting the power supply indicator lamp 48*a* at an interval of 0.6 seconds.

A step 348 in the flow 2-A is used for constantly storing the inputs to the microcomputer Q203 into a memory thereof, which is thereafter used for controlling the apparatus. A step 349 checks a memory whether or not accepting a key entry, and the key entry is disabled during the copying operation including the pre-rotation step but excluding the post-rotation step. Steps 350 to 350B automatically increase the set copy number by a timer of the step 350A when the plus key **46*b* is continuously actuated. A step 351 checks whether the plus key 46*b* has been set. Subsequent steps 352 and 353 check the actuation of the minus key 46*c*, and a step 354 checks the actuation of the clear key 46*d***.

As an example, when the plus key **46*b* is actuated, the step 351 identifies said actuation, and adds "1" to the content of the random access memory storing the display data with digit carry-over if necessary, and a step 351-2 displays the result of said addition on the segment display unit 46*a*. Said segment display unit 46*a* is already used for displaying other data, for example display "P" indicating the absence of recording sheet, but the step 351-2** displays the new data by resetting the already existing display data.

In response to the actuation of the minus key **46*c*, a deduction is conducted in a similar manner in a step 353-1 and the result of deduction is newly displayed in a step 351-2. Also in response to the actuation of the clear key 46*d*, a step 354 changes the content of said RAM to "1" which is displayed by a step 355**. Also at this display the existing data is reset and "1" is newly displayed.

In the present apparatus, in consideration of the characteristic of the driving circuit, the halogen heater H1 is turned on by entering a trigger pulse to the gate of a triac in synchronization with the zero-cross pulse, so that the halogen heater has to be turned off after it is turned on. A step 356 turns off the halogen heater H1 when it has been turned on.

A step 360 identifies if a copying operation has been instructed, and, during the standby state, a step 361 and the subsequent steps check key entries etc. for the sequence control means.

In the present apparatus, in case of a jam in the sequence, the flag F/JAM is set. A step 368 checks said flag, and, in case of a jam, an interruption flow is executed to prohibit subsequent interruptions, turn off the exposure lamp and the heater, and continuously light the jam indicator lamp.

A step 369 for heater control turns on and off the heater for each cycle in response to the detection of 185° C. A step 370 checks whether the manual sheet feed mode has been instructed, and if yes, steps 370A to 377 execute the check of the sheet feeding sensor Q2 and energize the manual sheet feeding solenoid SL4. More specifically, a check is made whether the manual sheet feeding solenoid has been enegized for a determined period when the sheet feed sensor is activated, and, if yes, the program proceeds to a step 377. If not, the expiration of the timer is checked after stepwise count-down, and this loop is repeated to continue the energization of said solenoid SL4 until the timer expires, thus continuing the transportation of the recording sheet. However, if the manually inserted sheet is forcedly pulled out by the operator, the program proceeds from the step 370A to a step 375, whereby the manual sheet feed solenoid SL4 is deactivated in a step 375-1 prior to the lapse of the determined period to interrupt the sheet transportation. In this manner the unnecessary operation of the apparatus can be prevented.

A step 371 and subsequent steps execute, in the cassette sheet feeding mode, the checks for the copy key **47*e*, stop key 46*d* etc. and the displays corresponding to the actuations of said keys. In response to the actuation of the stop key 46*d*, the program proceeds from a step 373 to a step 374 to change the display to "1", and, when the actuation of the copy key is identified in a step 371, the initial set value stored in the RAM 2 are supplied to the RAM 1 for display (step 375A). In this manner the initial set copy number is revived. Steps 377 and 378 execute the count down of a timer for the pre- and post-rotation steps, and the check for the expiration of said timer. A step 378 sets the flag F/AUTO in response to the timer expiration. Steps 379–380 execute the count down of a timer for the cassette sheet feed solenoid SL301 and the expiration of said timer, wherein said solenoid is deactivated upon timer expiration. A flow from a step 381 to 1-E check the abnormality in the original plate by a timer. Thereafter the program returns to 1-E** for repeating the above-explained procedure.

Figures 1, 18:
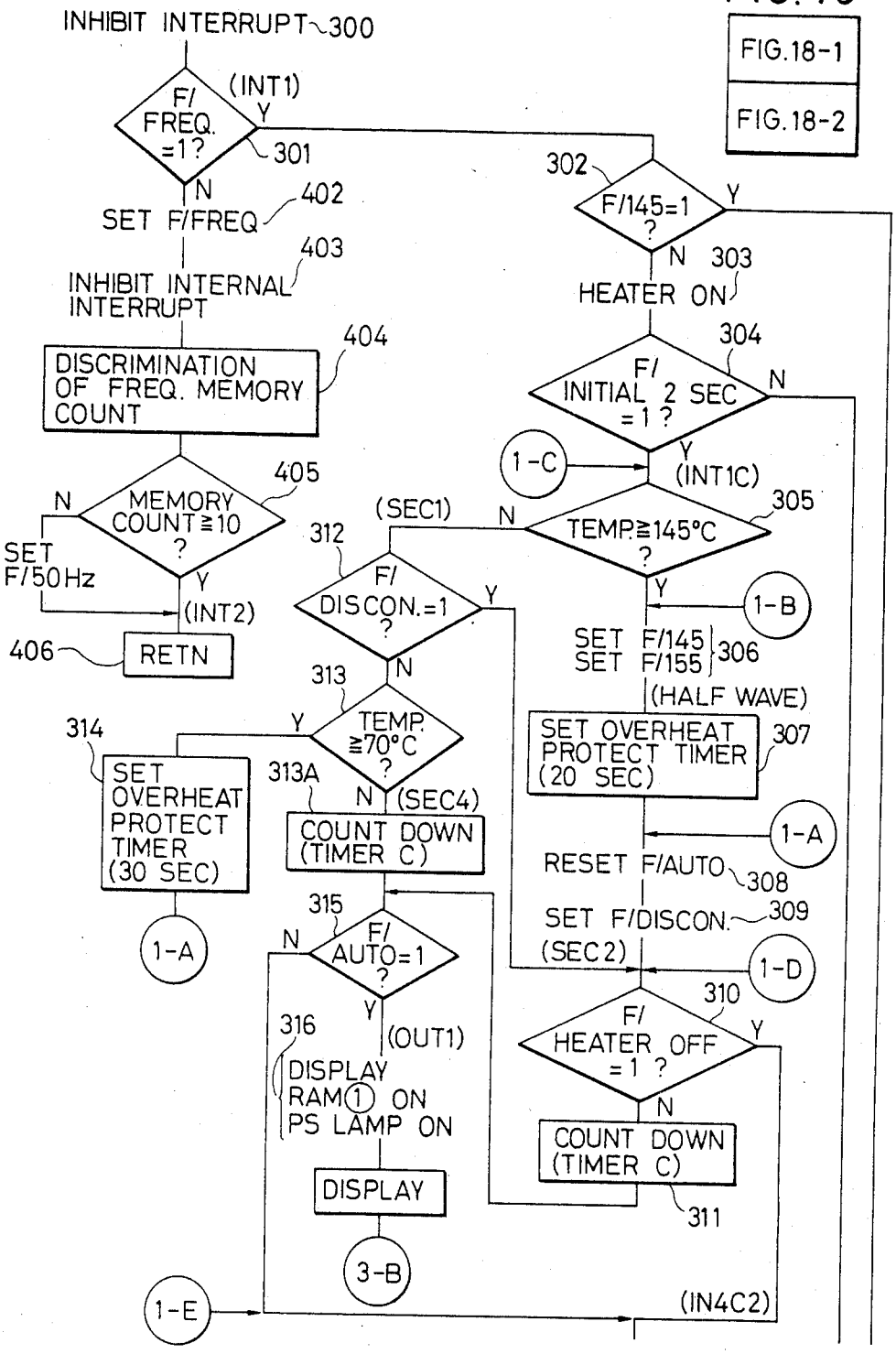
Figures 2, 18:
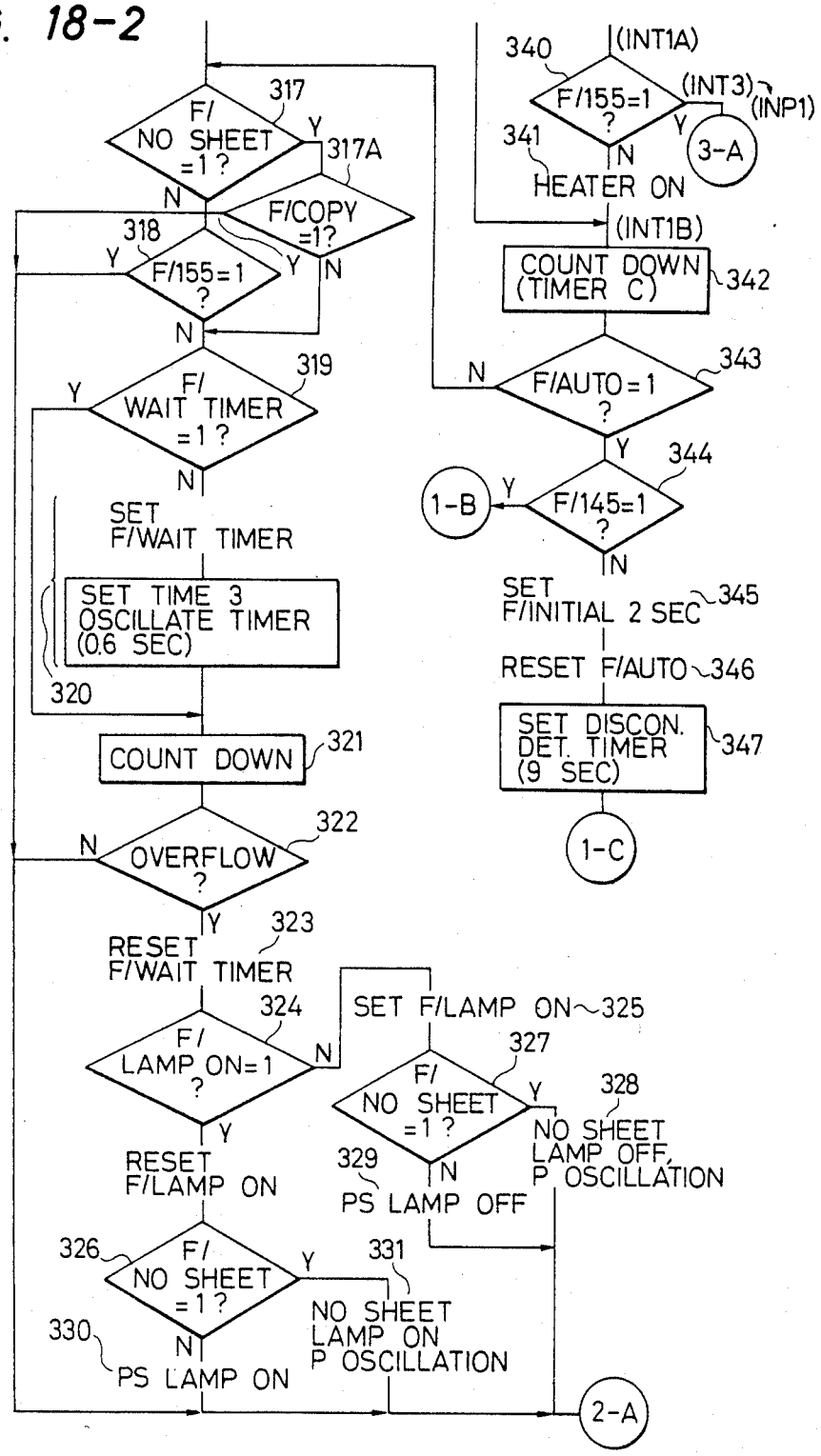

The flow chart shown in FIG. **16(*f*) may be replace by that shown in FIG. 18** for achieving a control to be explained in the following. The circuit structure and other flow charts are same as explained before and will not therefore be explained in detail.

In an embodiment to be explained in the following, in response to the detection of absence of recording sheet by the sheet feed sensor Q2 during a continuous copying operation with the attachment 13, the copier enters a copy stopping sequence, and the segment display unit **46*a* does not immediately indicate the absence of sheet but displays "□" indicating said absence after the lapse of a determined time. More specifically, in response to the detection of absence of sheet, the segment display unit 46*a* indicates said absence after the surface of the photosensitive drum is cleaned by the post-rotation step for a determined period. Consequently, even if the operator turns off the main switch MS immediately after the indication of absence of sheet, the drum surface can be maintained clean since the post-rotation step is already completed. Also in the present embodiment, during a period from the detection of absence of sheet to the corresponding display, the data shown on the segment display unit 46*a* remain unchanged even if the copy number setting keys 46*b*, 46*c*** are actuated.

Consequently, during a period from the detection of absence of sheet to a corresponding display, the data at said detection may be retained even if the copy number setting keys are erroneously actuated. In the present embodiment, the data entries by the copy number setting keys are enabled after the completion of usual copying operation or during post-rotation step.

Now there will be given a detailed explanation on the function while making reference to the flow chart. In case the step 142 in the flow chart shown in FIG. 16B identifies that the manual sheet feed mode is not instructed, a step 144 is executed to detect the presence of sheet with the sheet feeding sensor Q2. If a sheet is detected the program proceeds to a step 159. On the other hand, in the absence of detection a step 145 changes the timer for detecting abnormality in the original plate set in the step 135 to a timer for detecting delay jam, and the sheet detection is conducted until the expiration of said timer. If a sheet is detected before the expiration of said timer the program to the step 159. On the other hand, in the absence of sheet detection, a step 146 sets the flag F/NO SHEET, and a flow 6-B executes the post-rotation step (steps 222–224) while prohibiting the entries by all the keys including the copy number setting keys, and terminates the copying operation by turning off various loads. The procedure from the detection of absence of sheet to the termination of copying operation is constituted by the steps 146, 6-B,

207-1, 7-A and 235. The flag F/NO KEYING set in the step 130 for disabling the key entry remains in the set state until it is reset in a step 229-2. Consequently the key entry is enabled after the completion of post-rotation step when the absence of sheet is detected. After said completion a step 235 resets the flag F/COPY, whereby a step 317A in the interruption flow provides a negative discrimination to cause flickering display "P" on the display unit in steps 328 and 331. In this manner the display "P" indicating the absence of sheet is given after the completion of the post-rotation step. In the present embodiment the timing for enabling key entry is selected slightly earlier than the timing of display "P" for the absence of sheet, but these timings should appear simultaneous to the operator. Also it is possible to cause the display for absence of sheet before the key entry is enabled.

The present invention is by no means limited to the foregoing embodiments but is subject to various modifications within the scope of the appended claims.

What we claim is:

1. A temperature control apparatus for heating means, comprising:

temperature detecting means for detecting the temperature of said heating means;

means for detecting the zero-cross points of an AC power supply of said apparatus and generating corresponding zero-cross pulses; and control means for controlling said heating means in response to the temperature detected by said temperature detecting means to keep said heating means at a predetermined temperature;

wherein said control means, upon first turn-on of said heating means, selects one of a plurality of preset values of a timee, in response to the detected temperature, for determining the duration of power supply to said heating means, and wherein said control means controls said heating means in response to said zero-cross pulses and the detected temperature without utilizing said timer when a temperature of said heating means is near the predetermined temperature.

2. A temperature control apparatus according to claim 1, wherein said control means controls the power supply to said heating means in response to the detected temperature of said heating means.

3. An apparatus according to claim 1, wherein said control means includes a microcomputer arranged to execute a program for controlling said heating means at every time when said zero-cross pulse is inputted.

4. A temperature control apparatus for heating means, comprising:

temperature detecting means for detecting the temperature of said heating means;

means for detecting the zero-cross points of an AC power supply and generating corresponding zero-cross pulses; and control means for controlling said heating means in response to the temperature detected by said temperature detecting means;

wherein said control means controls said heating means in response to said zero-cross pulses and control counts of a first timer when the detected temperature is lower than a determined temperature, and supplies power to said heating means until said heating means reaches said determined temperature if the detected temperature does not reach said determined temperature at the expiration of said first timer.

5. A temperature control apparatus according to claim 4, wherein said control means is adapted to start a second timer when the detected temperature reaches said determined temperature.

6. A temperature control apparatus for heating means, comprising:

temperature detecting means for detecting the temperature of said heating means;

means for detecting the zero-cross points of an AC power supply and generating corresponding zero-cross pulses; and control means for controlling said heating means in response to the temperature detected by said temperature detecting means;

wherein said control means controls said heating means in response to said zero-cross pulses and control counts of a first timer when the detected temperature is lower than a determined temperature, and further controls said heating means in response to said zero-cross pulses and control counts of a second timer if the detected temperature does not reach said determined temperature at the expiration of said first timer.

7. A temperature control apparatus for heating means, comprising:

temperature detecting means for detecting the temperature of said heating means;

means for detecting the zero-cross points of an AC power supply and generating corresponding zero-cross pulses; and control means for controlling said heating means in response to the temperature detected by said temperature detecting means;

wherein said control means controls said heating means in response to said zero-cross pulses and control counts of a first timer when the detected temperature is lower than a determined temperature, and starts said first timer repeatedly if the detected temperature does not reach said determined temperature at the expiration of said first timer, and further controls said heating means in response to said zero-cross pulses and control counts of a second timer when the detected temperature reaches said determined temperature.

8. A temperature control apparatus comprising:

temperature detecting means for detecting temperature; and control means for controlling power supply to a load in response to an output signal from said temperature detecting means;

wherein said control means includes analog-to-digital converting means for performing an analog-to-digital conversion of the output signal from said temperature detecting means, and controls power supply to said load in accordance with the analog-to-digital converted value from said analog-to-digital converting means, and identifies whether said temperature detecting means is normal or not by discriminating the analog-to-digital converted value from said analog-to-digital converting means.

9. A temperature control apparatus according to claim 8, wherein said control means identifies whether said temperature detecting means is in a broken state or in an extreme temperature condition by discriminating the analog-to-digital converted value from said analog-to-digital converting means.

10. A temperature control apparatus according to claim 8, wherein said control means identifies whether the temperature is in an abnormal state or in normal state by discriminating the analog-to-digital converted value from said analog-to-digital converting means.

11. An apparatus according to claim 8, wherein said control means includes a microcomputer operable in accordance with a predetermined program.

12. An apparatus according to claim 8, wherein said load is a heater for fixing an image.

13. A temperature control apparatus comprising:

temperature detecting means for detecting temperature;

correcting means for correcting an output from said temperature detecting means;

means for detecting the zero-cross points of an AC power supply of said apparatus and generating corresponding zero-cross pulses;

analog-to-digital converting means for performing an analog-to-digital conversion of a correction signal from said correcting means; and control means for controlling power supply to a load on the basis of the analog-to-digital converted value from said analog-to-digital converting means each time a zero-cross pulse is inputted to said control means.

14. An apparatus according to claim 13, wherein said temperature detecting means is a thermistor and said correcting means includes a resistor connected in parallel with the thermistor.

15. An apparatus according to claim 13, wherein said control means includes a microcomputer operable to execute a program for controlling power supply to said load each time a zero-cross pulse is inputted to said control means.

16. A temperature control apparatus for heating means, comprising:

temperature detecting means for detecting the temperaturee of said heating means;

means for detecting the zero-cross points of an AC power supply of said apparatus and generating corresponding zero-cross pulses; and control means for controlling said heating means in response to the temperature detected by said temperature detecting means to keep said heating means at a predetermined temperature;

wherein said control means, upon first turn-on of said heating means, controls the start of a timer for determining the duration of power supply to said heating means in response to the detected temperature and wherein said control means controls said heating means in response to said zero-cross pulses and the detected temperature without utilizing said timer when a temperature of said heating means is near the predetermined temperature.

17. An apparatus according to claim 16, wherein said control means includes a microcomputer arranged to execute a program for controlling said heating means at every time when said zero-cross pulse is inputted.

* * * * *

UNITED STATES PATENT AND TRADEMARK OFFICE

CERTIFICATE OF CORRECTION

PATENT NO. : 4,656,338

DATED : April 7, 1987

INVENTOR(S) : TOSHIAKI YAGASAKI, ET AL.

It is certified that error appears in the above-identified patent and that said Letters Patent is hereby corrected as shown below:

IN THE DRAWINGS

FIG. 12(a), "THERMISTER" should read --THERMISTOR--.
FIG. 12(b), "THERMISTER" should read --THERMISTOR--.
FIG. 12(c), "THERMISTER" should read --THERMISTOR--.
FIG. 16(b)-1, "F/CASSETTF" should read --F/CASSETTE--.

COLUMN 5

Line 3, "respective" should read --respectively--.
Line 62, "or" should read --of--.
Line 68, "either" should read --when either--.

COLUMN 7

Line 55, "key" should read --keys--.

COLUMN 8

Line 27, "correspond signal" should read --correspond to signal--.
Line 68, "failure at" should read --failure of at--.

COLUMN 9

Line 2, "FIG. 7(a)" should read --FIG. 7(b)--.
Line 45, "not" should read --no--.

COLUMN 14

Line 23, "fullwave" should read --full-wave--.
Line 29, "of" should be deleted.

UNITED STATES PATENT AND TRADEMARK OFFICE

CERTIFICATE OF CORRECTION

PATENT NO. : 4,656, 338

DATED : April 7, 1987

INVENTOR(S) : TOSHIAKI YAGASAKI, ET AL.

It is certified that error appears in the above-identified patent and that said Letters Patent is hereby corrected as shown below:

COLUMN 16

Line 25, "signal assumes at" should read --signal at--.

COLUMN 17

Line 68, "thermister." should read --thermistor.--.

COLUMN 18

Line 6, "of" should read --off--.

COLUMN 19

Line 24, "functions" should read --function--.

COLUMN 21

Line 3, "check" should read --checks--.

COLUMN 22

Line 51, "the" should read --there is a--.

COLUMN 24

Line 16, "replace" should read --replaced--.
Line 60, "program to" should read --program proceeds to--.

UNITED STATES PATENT AND TRADEMARK OFFICE

CERTIFICATE OF CORRECTION

PATENT NO. : 4,656,338

DATED : April 7, 1987

INVENTOR(S) : TOSHIAKI YAGASAKI, ET AL.

It is certified that error appears in the above-identified patent and that said Letters Patent is hereby corrected as shown below:

COLUMN 25

Line 35, "timee," should read --timer,--.

COLUMN 28

Lines 10-11, "tem-/peraturee" should read --temperature--.

Signed and Sealed this

Twentieth Day of October, 1987

*Attest:*

DONALD J. QUIGG

*Attesting Officer*

*Commissioner of Patents and Trademarks*